US007794583B2

(12) United States Patent
Lyublinski

(10) Patent No.: US 7,794,583 B2
(45) Date of Patent: Sep. 14, 2010

(54) SYNERGISTIC CORROSION MANAGEMENT SYSTEMS FOR CONTROLLING, ELIMINATING AND/OR MANAGING CORROSION

(75) Inventor: Efim Ya Lyublinski, Solon, OH (US)

(73) Assignee: Northern Technologies International Corp., Circle Pines, MN (US)

( * ) Notice: Subject to any disclaimer, the term of this patent is extended or adjusted under 35 U.S.C. 154(b) by 219 days.

(21) Appl. No.: 11/732,902

(22) Filed: Apr. 5, 2007

(65) Prior Publication Data

US 2008/0247921 A1 Oct. 9, 2008

(51) Int. Cl.
*C23F 13/00* (2006.01)

(52) U.S. Cl. ..... 205/724; 205/740; 422/6; 422/7

(58) Field of Classification Search ..... 422/292, 422/6, 7; 205/724, 740
See application file for complete search history.

(56) References Cited

U.S. PATENT DOCUMENTS 5,209,869 A * 5/1993 Miksic et al. ..... 252/389.54
5,303,743 A * 4/1994 Vincent ..... 138/96 T
6,139,610 A * 10/2000 Sinko ..... 106/14.44
6,387,244 B1 * 5/2002 Lyublinski ..... 205/734
7,264,707 B1 * 9/2007 Furman et al. ..... 205/730
2003/0019872 A1 * 1/2003 Lyublinski et al. ..... 220/202

* cited by examiner

*Primary Examiner*—Sean E Conley
(74) *Attorney, Agent, or Firm*—Joseph J. Crimaldi; Roetzel & Andress

(57) ABSTRACT

The present invention generally relates to synergistic corrosion management systems designed to deliver two or more different types of corrosion inhibiting compounds (e.g., two or more different types of corrosion inhibiting compounds) to an enclosure, and to method for using same. More specifically, the present invention relates to synergistic corrosion management systems designed to eliminate, manage, control and/or mitigate corrosion in containers, enclosures, cisterns and/or storage tanks (e.g., above ground storage tanks). In one embodiment, the present invention utilizes a combination of at least one cathodic-based corrosion prevention or mitigation system, at least one soluble corrosion inhibitor, and at least one volatile or vapor phase corrosion inhibitor. In another embodiment, the present invention utilizes a combination of at least one cathodic corrosion prevention or mitigation system, at least one soluble corrosion inhibitor, and at least one volatile or vapor phase corrosion inhibitor to control, mitigate and/or eliminate corrosion in the bottom portions of above ground storage tanks.

35 Claims, 26 Drawing Sheets

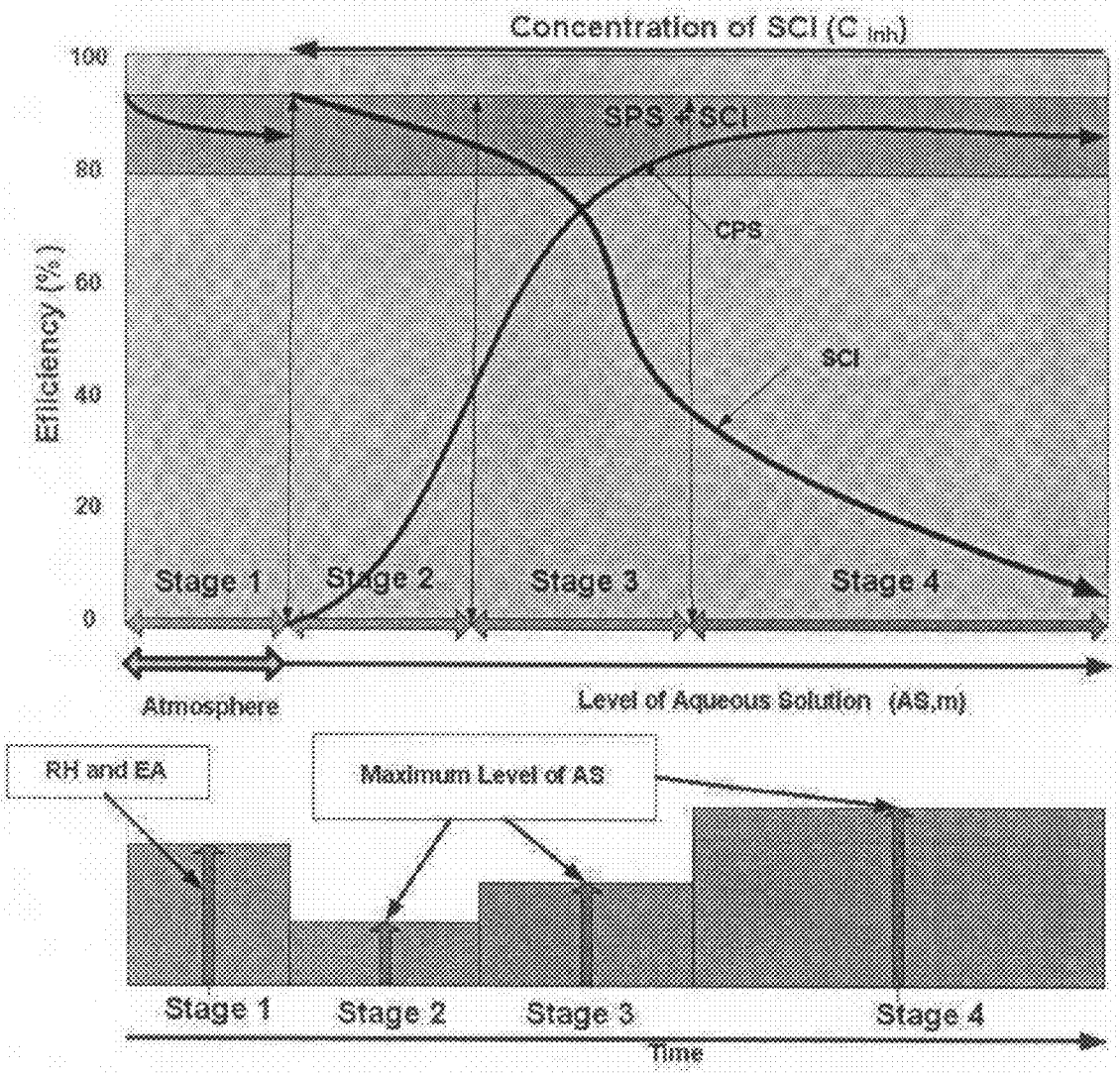
Figure 6. Principal of corrosion protection of Tanks Bottom Double Bottom
SPS – Cathodic Protection System - Galvanic or Impressed Current
VCI – Volatile (Vapor Space) Corrosion Inhibitor
SCI – Soluble Corrosion Inhibitor
RH – Relative Humidity
EA – Environment Aggressivenes

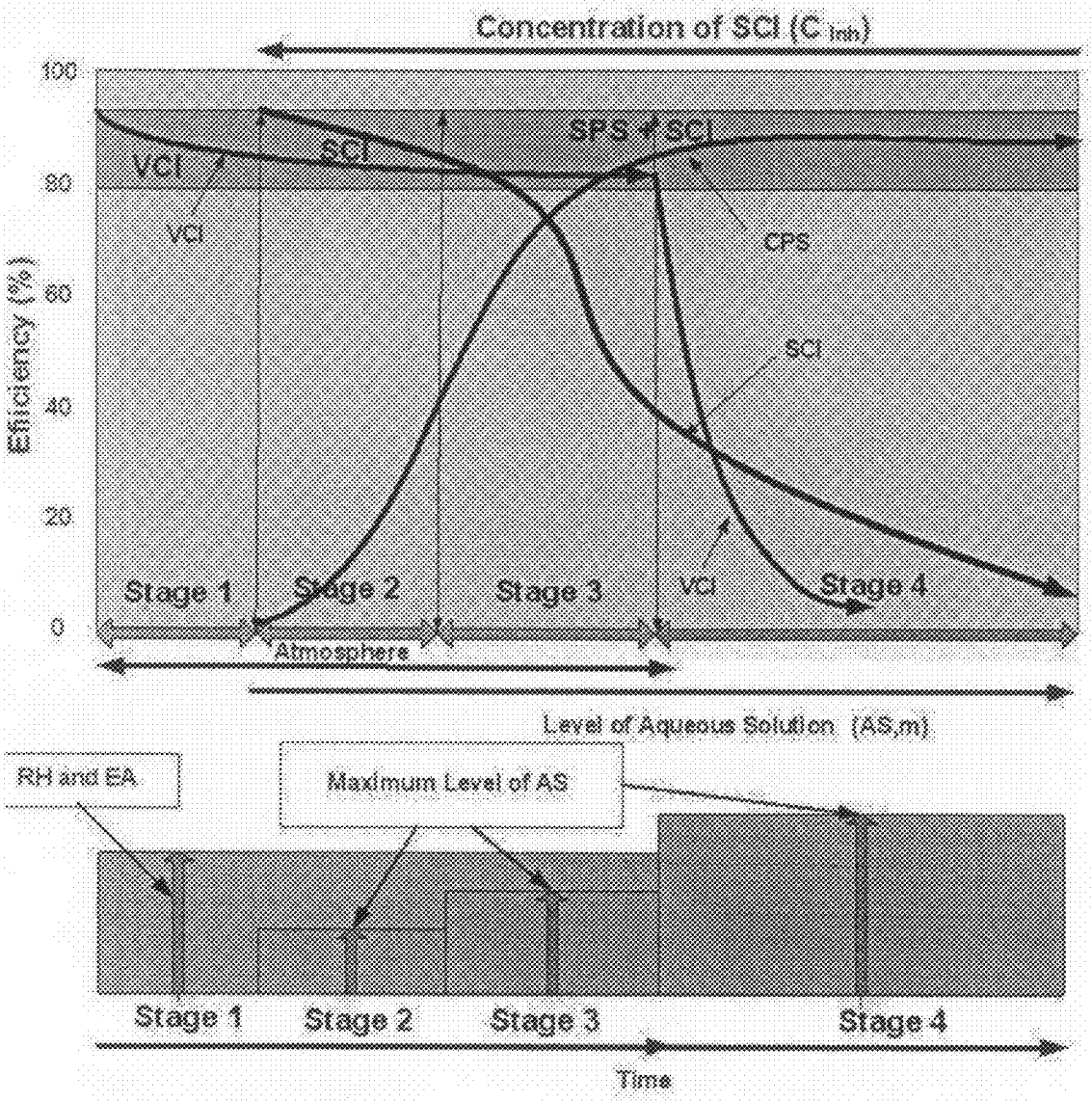
Figure 7. Principal of Corrosion Protection of Tank Walls of Double Bottoms
SPS – Cathodic Protection System - Galvanic or Impressed Current
VCI – Volatile (Vapor Space) Corrosion Inhibitor
SCI – Soluble Corrosion Inhibitor
RH – Relative Humidity
EA – Environment Aggressivenes

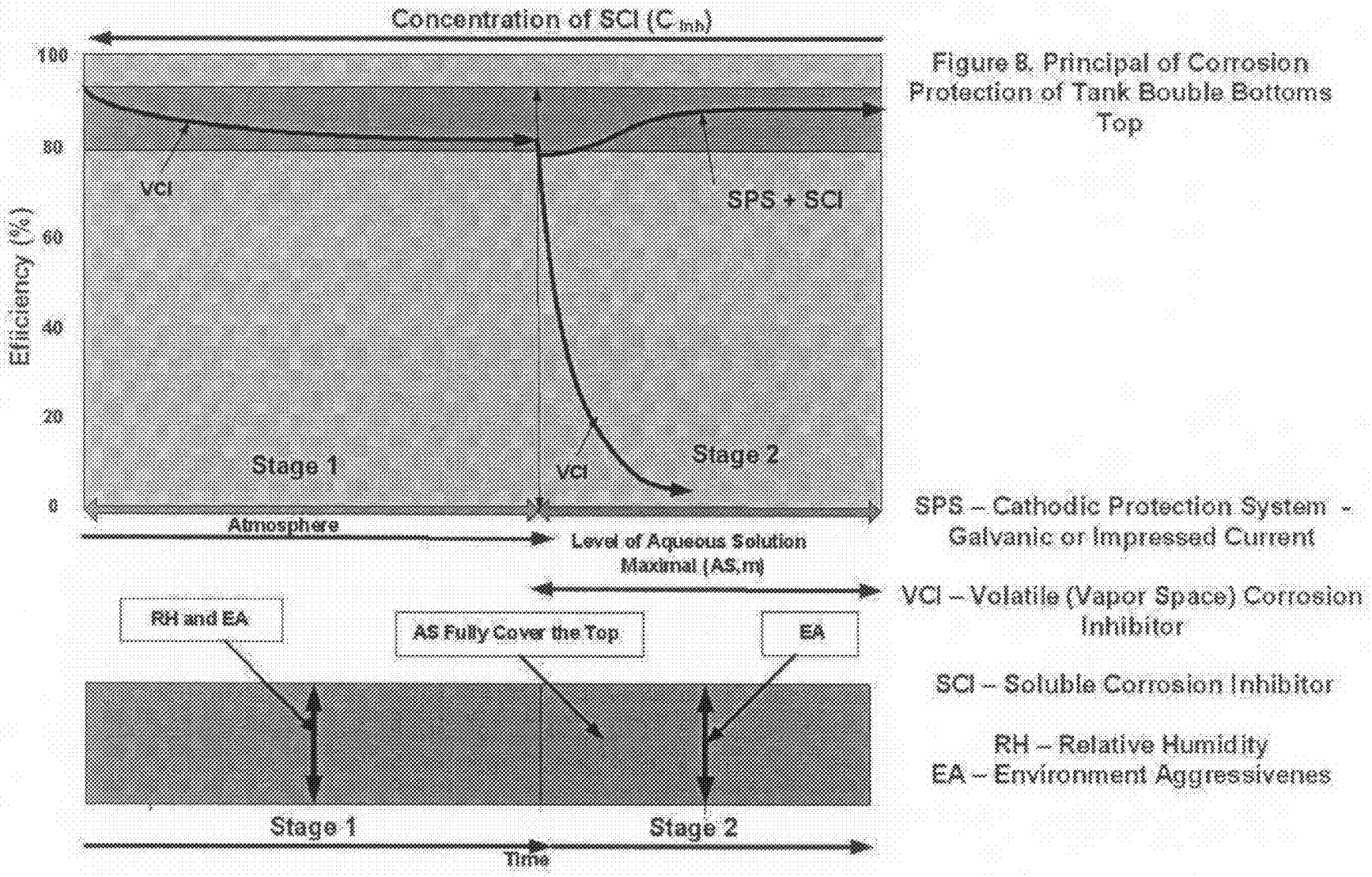
Figure 8. Principal of Corrosion Protection of Tank Bouble Bottoms Top

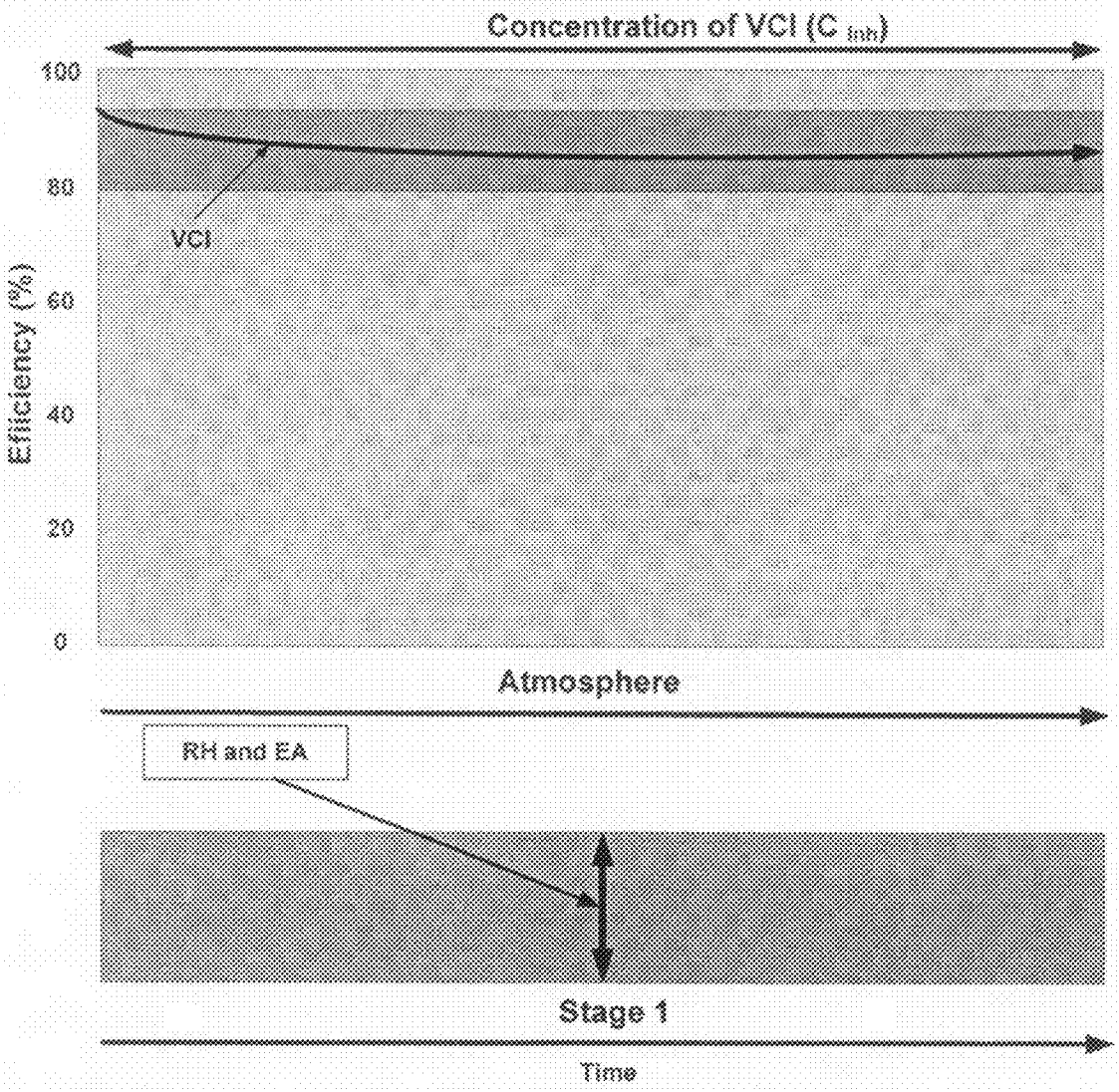
Figure 9. Principal of Corrosion Protection of Vapor Space of Tanks Double Bottoms Top
VCI – Volatile (Vapor Space) Corrosion Inhibitor
RH – Relative Humidity
EA – Environment Aggressiveness

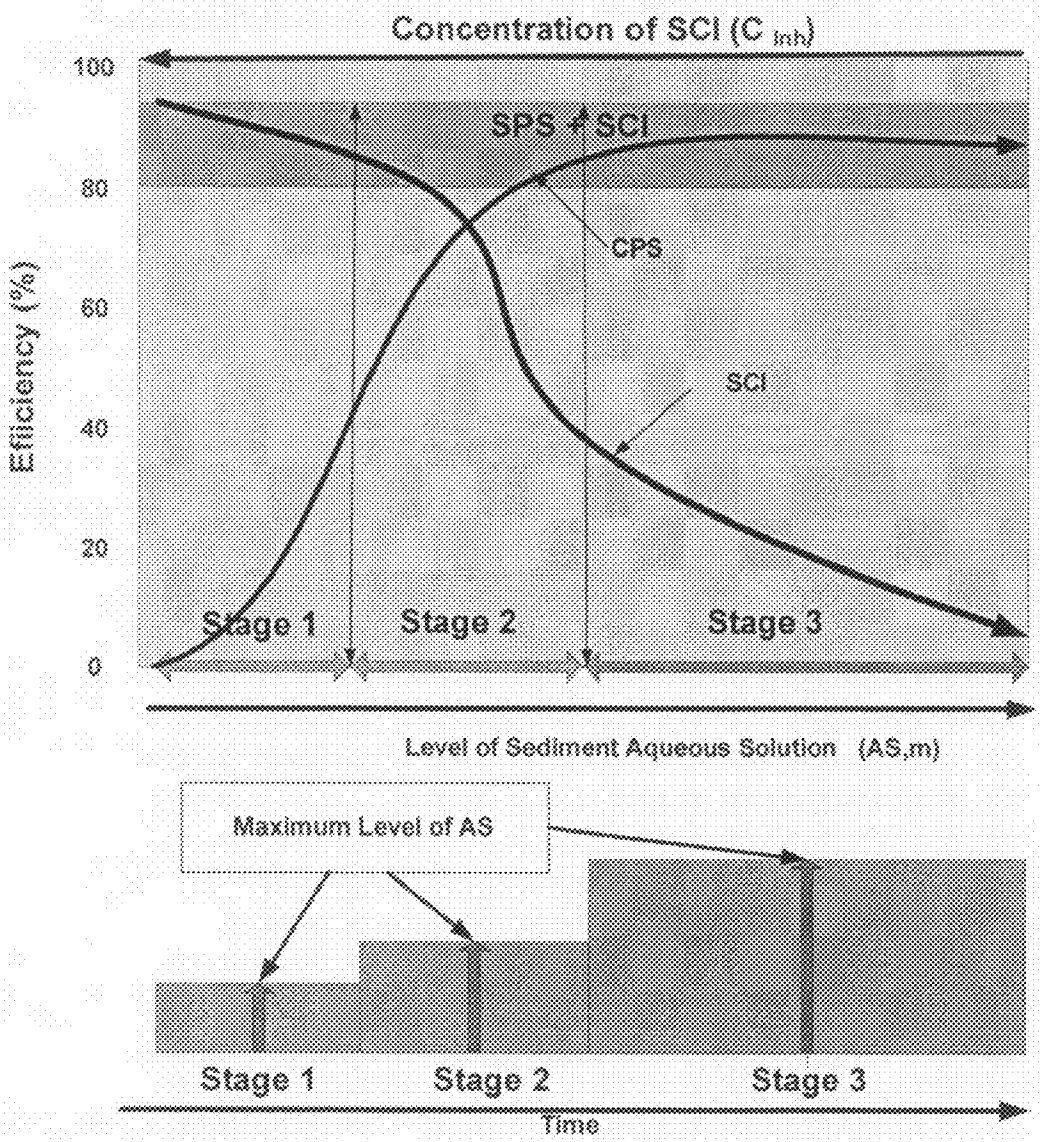
Figure 10. Principal of corrosion protection of Tanks Bottom internal surface
SPS – Cathodic Protection System Galvanic or Impressed Current
SCI – Soluble Corrosion Inhibitor

SYNERGISTIC CORROSION MANAGEMENT SYSTEMS FOR CONTROLLING, ELIMINATING AND/OR MANAGING CORROSION

FIELD OF THE INVENTION

The present invention generally relates to synergistic corrosion management systems designed to deliver two or more different types of corrosion inhibiting compounds (e.g., two or more different types of corrosion inhibiting compounds) to an enclosure, and to method for using same. More specifically, the present invention relates to synergistic corrosion management systems designed to eliminate, manage, control and/or mitigate corrosion in containers, enclosures, cisterns and/or storage tanks (e.g., above ground storage tanks). In one embodiment, the present invention utilizes a combination of at least one cathodic-based corrosion prevention or mitigation system, at least one soluble corrosion inhibitor, and at least one volatile or vapor phase corrosion inhibitor. In another embodiment, the present invention utilizes a combination of at least one cathodic corrosion prevention or mitigation system, at least one soluble corrosion inhibitor, and at least one volatile or vapor phase corrosion inhibitor to control, mitigate and/or eliminate corrosion in the bottom portions of above ground storage tanks.

BACKGROUND OF THE INVENTION

In commerce and industry today, the useful life of a variety of items may be extended and/or preserved by providing one or more suitable inhibitors. An inhibitor is a compound or group of compounds which can slow or negate the rate of corrosion, decomposition, degradation and/or spoilage of a given item due to, for example, corrosion or oxidation. For example, certain metals are prone to corrosion and/or tarnishing. A suitable inhibitor, in such a case, would be a compound (or group of compounds) which acts as a corrosion inhibitor thereby protecting a desired item or items from the adverse effects of its ambient environment.

Among the common indications of corrosion manifested in useful metallic articles is oxidation, pitting, tarnishing, mottling or discoloration of the surfaces of these items. These manifestations occur in metallic articles, particularly when exposed to chlorides, $SO_x$, $CO_2$, $H_2S$, oxygen and/or water, in either gaseous or liquid phase. Additionally, sulfides, chlorides (or chlorine), carbon dioxide and/or sulfur dioxide may cause corrosion or tarnishing problems as well. Inasmuch as both oxygen and water, including water vapor, occur normally and are available in nature, it is normally necessary to take precautions against corrosion in metal containing, or metallic, items during normal use. Metals which are frequently found to be susceptible to corrosion under normal atmospheric and ambient conditions include, but are not limited to, iron, aluminum, and alloys of these metals. Additionally, suitable protection may also be needed for hybrid articles (i.e., articles that are partially metal or contain a significant amount of metal therein) such as reinforced concrete.

In view of the widespread need for protecting various articles from corrosion, whether the articles be metallic or otherwise, a variety of short-lived systems have been utilized. For example, the use of VCI capsules permits a producer/manufacturer to place a VCI capsule in an existing packaging system or enclosure (e.g., a storage tank), without having to redesign same, while still making sure that the products contained within the packaging are protected against corrosion, tarnishing or some other form of degradation. However, VCI based systems are generally limited to protecting metallic surfaces, or other corrosion prone surfaces, that are in contact with air, some other gas, or a gaseous atmosphere.

Alternatively, cathodic corrosion management systems permit one to mitigate and/or reduce the rate of corrosion that occurs in hybrid structures such as reinforced concrete and in metallic structures such as storage tanks (both above and below ground varieties). Such cathodic systems have drawbacks including the ability to only protect those metal parts, or surfaces that are in current contact with the cathodic system, or in the case of electrolyte-based cathodic systems only those surfaces that are fully immersed in a suitable electrolyte. Thus, in the case of cathodic systems, various surfaces remain unprotected (e.g., surfaces in contact with vapor spaces, air, or some other gas).

In other instances, soluble corrosion inhibitors have been utilized to protect, for example, a liquid that is being stored within a storage tank. Such systems suffer from various drawbacks including: (1) a situation where the amount of soluble corrosion inhibitor necessary to provide protection to the tank leads to contamination of the liquid stored therein; and/or (2) the situation where the soluble corrosion inhibitor is only effective in protecting against corrosion that occurs in one discrete portion of a liquid in a storage tank (e.g., water or some other aqueous liquid in an oil storage tank).

Such methods, although effective, are not suitable for all tanks, containers, and/or closed systems which may need to be protected. Additionally, such methods have service lives which are not suitable for applications, in which a long service life is necessary, for example, the use of cathodic systems to protect storage tanks which hold petroleum products. Furthermore, the replenishment of certain currently used systems, such as cathodic systems, is both expensive and difficult.

Turning to storage tanks, and specifically above ground storage tanks, multiple environmental factors affect corrosion of such storage tanks, and in particular, if present, the double-bottom internal surfaces of such tanks. Such factors include, but are not limited to, the age of the tank, the surface area exposed or in contact with at least one corrosive environment, the water saturation level of the sand inside the tank bottom, and the occurrence of one or more vapor spaces. Since changes in the relative importance of these factors during the lifetime of a storage tank can not be predicted, current technologies do not provide adequate protection against all existing factors.

Existing methods have the following disadvantages: (1) electrolyte-based cathodic protection alone works only when any internal metallic surfaces of the tank to be protected, (e.g., the double bottoms) are fully immersed in the electrolyte (i.e., no vapor spaces); (2) soluble corrosion inhibitors alone are effective only in relatively high concentrations and only when any internal metallic surfaces of the tank to protected, (e.g., the double bottoms) are fully immersed in the solvent carrying the desired soluble corrosion inhibitor (i.e., no vapor spaces); (3) electrolyte-based cathodic protection in combination with one or more soluble corrosion inhibitors, where the one or more soluble corrosion inhibitors are present in the electrolyte of the cathodic system, are efficient, but again only function efficiently when any internal metallic surfaces of the tank to protected, (e.g., the double bottoms) are fully immersed in the electrolyte (i.e., no vapor spaces); and (4) filling and draining of the tank causes the tank bottom to flex and undulate which causes vapor spaces to be created and leads to one or more of the above drawbacks. Since these vapor spaces may be uniform or in isolated pockets, they can cause the electrolyte of an electrolyte-based cathodic corrosion prevention or mitigation system to lose contact with the upper metallic surface thereby rendering the electrolyte-based cathodic corrosion prevention or mitigation system and soluble corrosion inhibitor system ineffective.

Additionally, once a electrolyte-based cathodic corrosion prevention or mitigation system with a soluble corrosion inhibitor therein has been implemented, the efficiency of the system cannot be modified while the tank is in operation. In such situations, it becomes necessary after a period of time to stop using such a tank in order to replenish and/or service such a system.

Thus, there is a need in the art for a system and method which provides flexible corrosion protection in light of, or in response to, a changing environment and/or application conditions, while at the same time permitting the flexible delivery of differing amounts of one or more volatilizable compounds.

SUMMARY OF THE INVENTION

The present invention generally relates to synergistic corrosion management systems designed to deliver two or more different types of corrosion inhibiting compounds (e.g., two or more different types of corrosion inhibiting compounds) to an enclosure, and to method for using same. More specifically, the present invention relates to synergistic corrosion management systems designed to eliminate, manage, control and/or mitigate corrosion in containers, enclosures, cisterns and/or storage tanks (e.g., above ground storage tanks). In one embodiment, the present invention utilizes a combination of at least one cathodic-based corrosion prevention or mitigation system, at least one soluble corrosion inhibitor, and at least one volatile or vapor phase corrosion inhibitor. In another embodiment, the present invention utilizes a combination of at least one cathodic corrosion prevention or mitigation system, at least one soluble corrosion inhibitor, and at least one volatile or vapor phase corrosion inhibitor to control, mitigate and/or eliminate corrosion in the bottom portions of above ground storage tanks.

In one embodiment, the present invention relates to a synergistic system for protecting a portion of a tank, enclosure, or container, the system comprising: (i) at least one volatile or vapor phase corrosion inhibitor, wherein the at least one volatile or vapor phase corrosion inhibitor is selected so as to prevent or reduce the amount of one or more corrosive compounds in at least one vapor space within an area located below a bottom, or double bottom, of a tank, enclosure, or container; (ii) at least one soluble corrosion inhibitor, wherein the at least one soluble corrosion inhibitor is contained within a suitable solvent, and wherein the at least one soluble corrosion inhibitor is selected so as to prevent or reduce the amount of one or more corrosive compounds in at least one liquid that is contained within an area located below a bottom, or double bottom, of a tank, enclosure, or container; and (iii) at least one cathodic-based corrosion prevention or mitigation system, wherein the at least one cathodic-based corrosion prevention or mitigation system is designed to prevent or reduce the amount of corrosion that occurs in at least one metal bottom, or double bottom, portion of the tank, enclosure, or container.

In another embodiment, the present invention relates to a synergistic system for protecting a portion of a tank, enclosure, or container, the system comprising: (a) at least one volatile or vapor phase corrosion inhibitor, wherein the at least one volatile or vapor phase corrosion inhibitor is designed to prevent or reduce the amount of one or more corrosive compounds in at least one vapor space within an area located below a bottom, or double bottom, of a tank, enclosure, or container; (b) at least one soluble corrosion inhibitor, wherein the at least one soluble corrosion inhibitor is contained within a suitable solvent, and wherein the at least one soluble corrosion inhibitor is designed to prevent or reduce the amount of one or more corrosive compounds in at least one liquid that is within an area located below a bottom, or double bottom, of a tank, enclosure, or container; and (c) at least one electrolyte-based cathodic corrosion prevention or mitigation system, wherein the electrolyte of the at least one electrolyte-based cathodic corrosion prevention or mitigation system also serves as the solvent for the at least one soluble corrosion inhibitor, and wherein the at least one electrolyte-based cathodic corrosion prevention or mitigation system is designed to prevent or reduce the amount of corrosion that occurs in at least one metal bottom, or double bottom, portion of the tank, enclosure, or container.

BRIEF DESCRIPTION OF THE DRAWINGS

FIGS. 6 through 10 are graphs illustrating the synergistic advantages of the present invention versus the use of just single protection schemes for preventing corrosion in the double bottoms, or bottoms, of a storage tank;

DETAILED DESCRIPTION OF THE INVENTION

Figure 1:
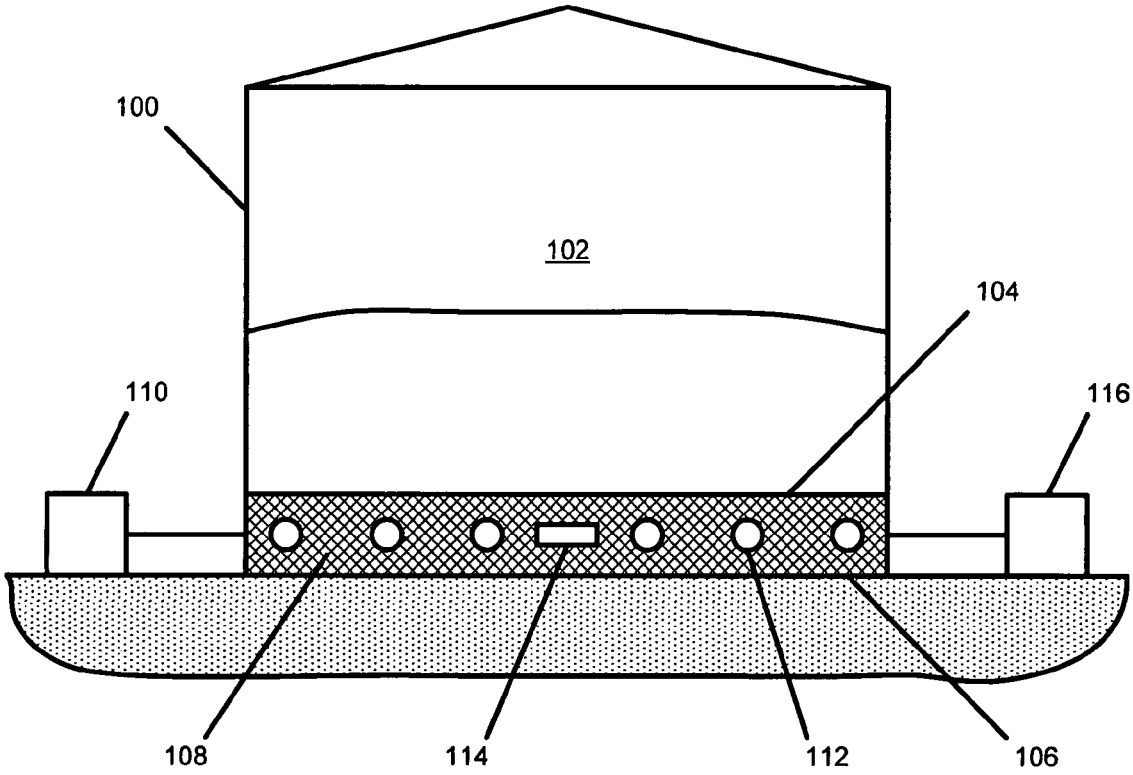
FIG. 1 is an illustration of one system in accordance with one embodiment of the present invention, where such a system is applied to a storage tank having a double bottom.

The present invention generally relates to synergistic corrosion management systems designed to deliver two or more different types of corrosion inhibiting compounds (e.g., two or more different types of corrosion inhibiting compounds) to an enclosure, and to method for using same. More specifically, the present invention relates to synergistic corrosion management systems designed to eliminate, manage, control and/or mitigate corrosion in containers, enclosures, cisterns and/or storage tanks (e.g., above ground storage tanks). In one embodiment, the present invention utilizes a combination of at least one cathodic-based corrosion prevention or mitigation system, at least one soluble corrosion inhibitor, and at least one volatile or vapor phase corrosion inhibitor. In another embodiment, the present invention utilizes a combination of at least one cathodic corrosion prevention or mitigation system, at least one soluble corrosion inhibitor, and at least one volatile or vapor phase corrosion inhibitor to control, mitigate and/or eliminate corrosion in the bottom portions of above ground storage tanks.

The synergistic corrosion management systems of the present invention described herein relates generally to systems, devices and/or methods for preventing and/or reducing the occurrence of corrosion in a variety of articles including, but not limited to, tanks (e.g., storage tanks, septic tanks, fuel tanks, etc.); containers (e.g., shipping containers, storage containers, etc.); semi-closed systems (e.g., fuel systems, septic systems, reservoirs, etc.); and/or closed systems (e.g., waste disposal systems, waste disposal drums or containers, etc.). More specifically, the present invention relates to systems, devices or methods for preventing and/or reducing the occurrence of corrosion in a variety of articles including, but not limited to, metallic tanks; metallic containers; semi-closed systems; and/or closed systems which are constructed partially or totally from metal (e.g., steel, iron, copper, brass, aluminum, etc.).

As used throughout the text and claims, a semi-closed system means a system which is opened periodically to replenish, fill or deposit something therein (e.g., a fuel tank, a storage tank, etc.). As used throughout the text and claims, a tank includes any type of closed storage tank or tank designed to hold one or more liquids and/or gases (e.g., a fuel tank, an above ground storage tank). As used throughout the text and claims, a storage enclosure means any storage enclosure, be it semi-closed or closed, that is used to store at least one liquid, gas, or combination thereof.

Additionally, as used throughout the text and claims, corrosion includes not only tarnishing, rusting and other forms of corrosion, but also includes any detrimental or unwanted degradation of an article to be protected. As such, when the phrases "corrosion inhibiting compound(s)" or "corrosion inhibitor(s)" are used herein, these phrases also include tarnish inhibiting compound(s) or tarnish inhibitor(s). In one embodiment, the corrosion inhibiting compound or compounds utilized in conjunction with the present invention are selected from one or more volatile or vapor phase corrosion inhibitors, one or more soluble corrosion inhibitors, or any suitable combinations thereof.

As used throughout the text and claims, corrosion inhibitor means any compound, whether volatile or not, which inhibits at least one form of corrosion or degradation from occurring on an object to be protected. As used throughout the text and claims, a soluble corrosion inhibitor means any compound, be it solid, liquid, or gas, that is soluble in at least one liquid. As used throughout the text and claims, volatile phase corrosion inhibitor and vapor phase corrosion inhibitor are used interchangeably and both mean that such types of corrosion inhibitors are transferred to the surface of the item/article/surface to be protected by condensation of the volatile/vapor phase corrosion inhibitor's vapor on the surface of the item/article/surface to be protected.

As used throughout the text and claims, a sealable enclosure means any enclosure which can be sealed by any suitable means so as to maintain a high concentration of one or more corrosion inhibiting compounds, one or more vapor phase corrosion inhibiting compounds, or one or more volatile corrosion inhibiting compounds remote from an exterior environment until the release of such one or more inhibiting compounds is desired into an environment that is exterior to the sealable enclosure. Additionally, it should be noted that in the following text, range and/or ratio limits may be combined.

As is noted above, in one embodiment the present invention utilizes a combination of at least one cathodic-based corrosion prevention or mitigation system, at least one soluble corrosion inhibitor, and at least one volatile or vapor phase corrosion inhibitor. In another embodiment, the present invention utilizes a combination of at least one cathodic corrosion prevention or mitigation system, at least one soluble corrosion inhibitor, at least one volatile or vapor phase corrosion inhibitor to control, mitigate and/or eliminate corrosion in the bottom portions of above ground storage tanks. Due to the combination of discrete elements as is noted above, the systems of the present invention provide synergistic effects that are unavailable when just one type, or even any two types, of the above corrosion inhibiting systems are utilized. In the following text each discrete portion of the synergistic corrosion management systems of the present invention will be explained in detail.

The synergistic corrosion management systems/devices of the present invention can be used to protect against a wide variety of corrosive compounds and/or atmospheres. Such compounds/atmospheres include, but are not limited to, water (either liquid or vapor phase), oxygen, sulfides, chlorides, $NO_x$, $SO_x$ or chlorine.

Initially, the present invention will be described in relation to embodiments designed to reduce, mitigate and/or eliminate the occurrence of corrosion in various types of storage tanks, and in particular the exterior and/or interior surfaces of the bottoms of such storage tanks. However, the present invention is not limited to just the above-mentioned embodiments. Rather, the present invention is to be broadly construed and could be, for example, modified to reduce, mitigate and/or eliminate the occurrence of corrosion in one or more metal or metallic portions of storage tanks.

Synergistic Tank Bottom Systems:

In one embodiment, the present invention relates to three-part synergistic corrosion management systems designed to specifically reduce, mitigate and/or eliminate the occurrence of corrosion in various types of storage tanks, and in particular the exterior and/or interior surfaces of the bottoms of such storage tanks. Turning to FIGS. 1 through 5, various embodiments of a synergistic corrosion management system designed to reduce, mitigate and/or eliminate the occurrence of corrosion in the exterior and/or interior surfaces of the bottoms of various types of storage tanks are illustrated. With regard to FIGS. 1 through 5, like reference numerals refer to like parts.

With specific reference to FIG. 1, FIG. 1 discloses a storage tank 100 that contains therein a liquid (e.g., oil, gas, etc.) in storage area 102. As can be seen in FIG. 1, tank 100 has a double bottom with the top and bottom surfaces of the double bottom of tank 100 being designated as 104 and 106, respectively. In one embodiment, both top and bottom surfaces 104 and 106, respectively, of tank 100 are constructed partially or totally from metal (e.g., steel, iron, copper, brass, aluminum, etc.). Area 108 formed by top and bottom surfaces 104 and 106, respectively, of tank 100 is filled with some type of supporting matter (e.g., sand, limestone, stone, carbon powder, etc.) in order to provide support to top 104 of the double bottom of tank 100. As can be seen in FIG. 1, top surface 104 of the double bottom of tank 100 is also the bottom of storage area 102 of tank 100.

Furthermore, tank 100 is also connected to various servicing systems for both tank 100 and for the synergistic corrosion management systems in accordance with the present invention. Such various servicing systems can be, but are not limited to, one or more test stations, rectifiers, supply pipes, drainage pipes, etc. Although, only one such servicing system 110 is shown in connection with tank 100, the present invention is not limited to solely this embodiment. Instead, as is known in the art, tank 100 could have multiple systems attached thereto.

Also illustrated in FIG. 1 is a cathodic corrosion prevention or mitigation system that comprises one portion of the synergistic corrosion management system of the embodiment of FIG. 1. As is illustrated in FIG. 1, the cathodic-based corrosion prevention or mitigation system illustrated therein comprises at least one anode 110 and at least one reference electrode 112 that act in combination to reduce, prevent and/or mitigate corrosion within double bottom area 108 of tank 100. In combination with the above-mentioned cathodic-based corrosion prevention or mitigation system, the present invention also utilizes at least one at least one volatile or vapor phase corrosion inhibitor system and at least one soluble corrosion inhibitor system. The at least one volatile or vapor phase corrosion inhibitor system is designed to protect any vapor or air spaces which exist, or develop, in area 108 of tank 100, while the at least one soluble corrosion inhibitor system is designed to provide further protection to area 108 of tank 100 via the use of a liquid that contains therein at least one soluble corrosion inhibitor. Each part of the synergistic corrosion management systems of the present invention, as such systems relate to the protection of tank double bottoms, will be explained in detailed below with reference to FIGS. 2A through 5D. Additionally, the synergistic corrosion management systems of this embodiment also include at least one servicing module 116, which is designed to supply needed materials and/or extend the service life of the synergistic systems of the present invention.

Regarding tank 100, although tank 100 is shown as having an above-ground double bottom, the present invention is not limited thereto. Rather, as would be apparent to those of skill in the art, the present invention could be designed to protect the bottom of various designs of storage tanks including the tops and/or bottoms of the double bottom portions of double bottom-containing storage tanks (see FIGS. 2A through 3D) and/or the bottoms of storage tanks (see FIGS. 4A through 5D) regardless of whether such double bottoms and/or bottoms are above, at, or below ground level.

Turning to FIGS. 2A through 2D, one embodiment of a three-part synergistic corrosion management system for a tank double bottom is illustrated therein. In the embodiment of FIGS. 2A through 2D, the synergistic corrosion management system of the present invention utilizes a combination of: (1) at least one cathodic-based corrosion prevention or mitigation system (as is shown in FIG. 1 and partially represented by anodes 112 in FIG. 2); (2) at least one soluble corrosion inhibitor in a suitable solvent; and (3) at least one volatile corrosion inhibitor to protect area 108 of a double bottom tank 100.

In one embodiment, the at least one cathodic-based corrosion prevention or mitigation system of the above-mentioned three-part systems also utilizes at least one liquid electrolyte solution to provide enhance protection to the double bottom of tank 100. Suitable cathodic systems (galvanic or impressed current systems) for use in the present invention include, but are not limited to, galvanic systems that utilize sacrificial anodes formed from zinc, aluminum, and/or magnesium alloys, or impressed current anodes (platinum, metal oxide, graphite, etc.), rectifiers for impressed current, reference electrodes, etc.

In the case of the embodiment of FIGS. 2A through 2D, the one or more soluble corrosion inhibitors are dissolved in a suitable solvent and are supplied to the double bottom area 108 of tank 100 via any suitable supply means. Suitable supply means for delivering the initial and/or any subsequently needed corrosion inhibitor impregnated solvent to double bottom area 108 include, but are not limited to, servicing module 116 (FIG. 1), one or more supply pipes, periodic tank deliveries, etc. In another embodiment, two or more delivery technologies are utilized. In one embodiment, the one or more soluble corrosion inhibitors in a suitable solvent are delivered periodically, or on an as needed basis, based on remote monitoring, human monitoring, computer-based monitoring, etc.

Figure 2A:
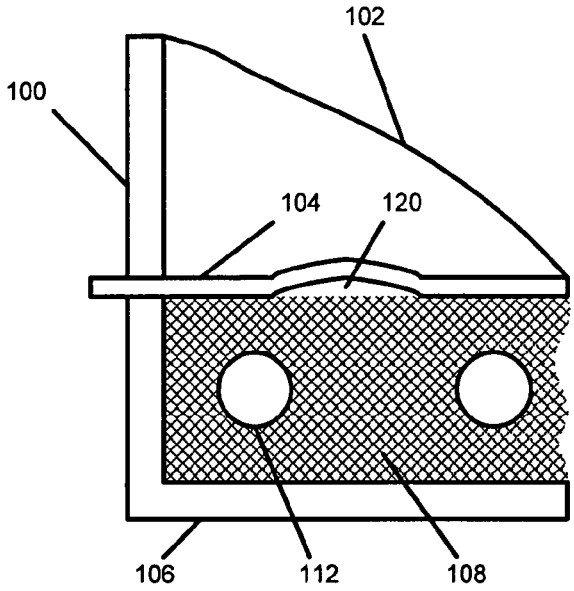
FIGS. 2A through 2D are a set of close-up illustrations of a double-bottomed storage tank that illustrate one embodiment of a synergistic corrosion management system in accordance with the present invention that is designed to protect the double bottom of an above ground storage tank.
Figure 2B:
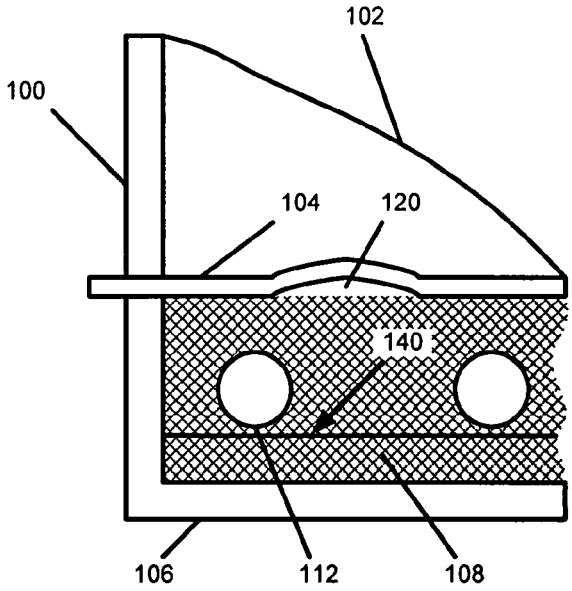
Figure 2C:
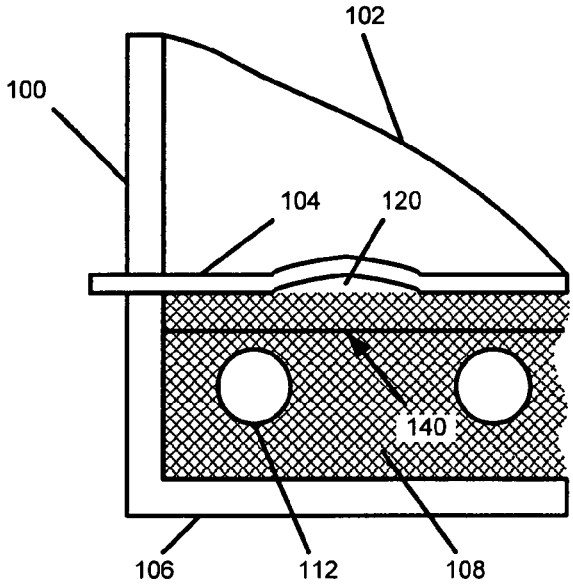
Figure 2D:
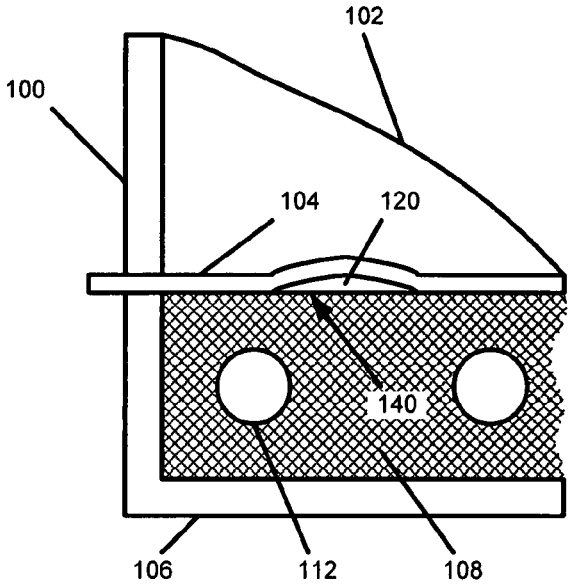
Figure 3A:
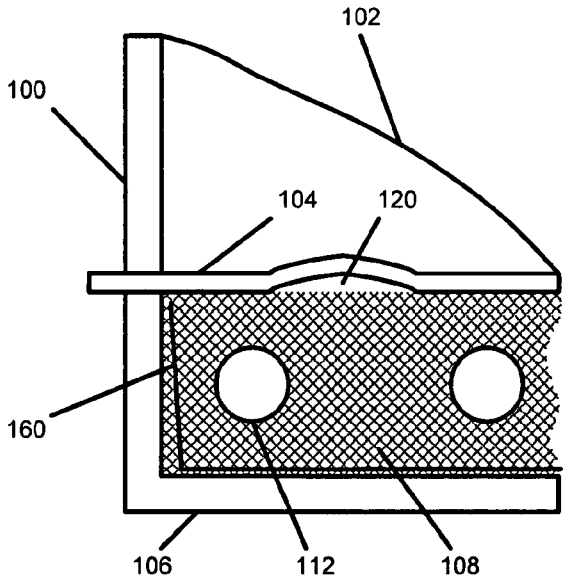
FIGS. 3A through 3D are a set of close-up illustrations of a double-bottomed storage tank that illustrate another embodiment of a synergistic corrosion management system in accordance with the present invention that is designed to protect the double bottom of an above ground storage tank.
Figure 3B:
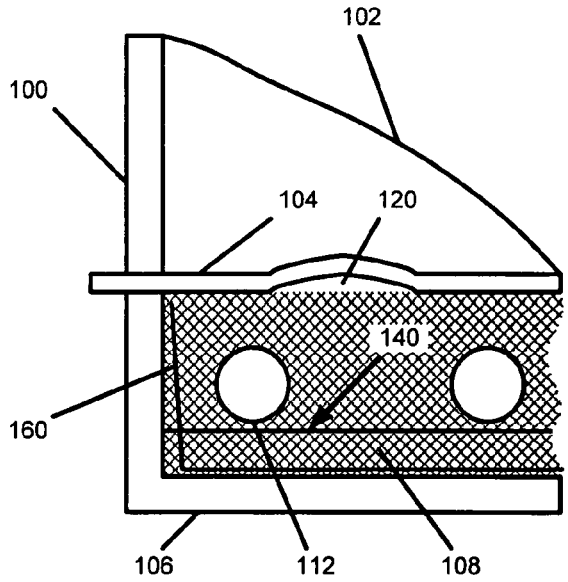
Figure 3C:
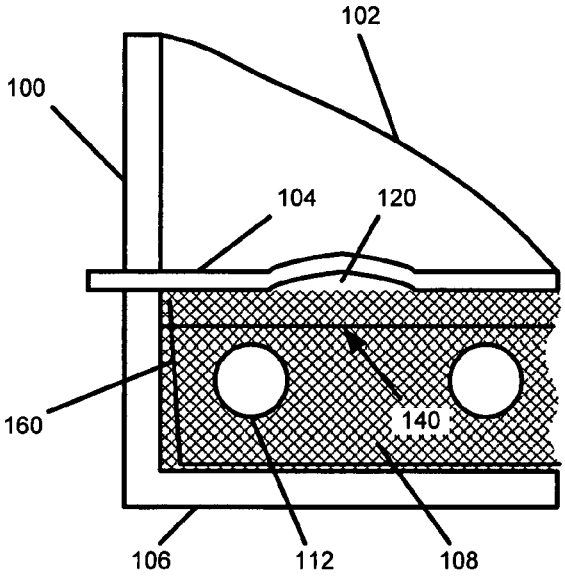
Figure 3D:
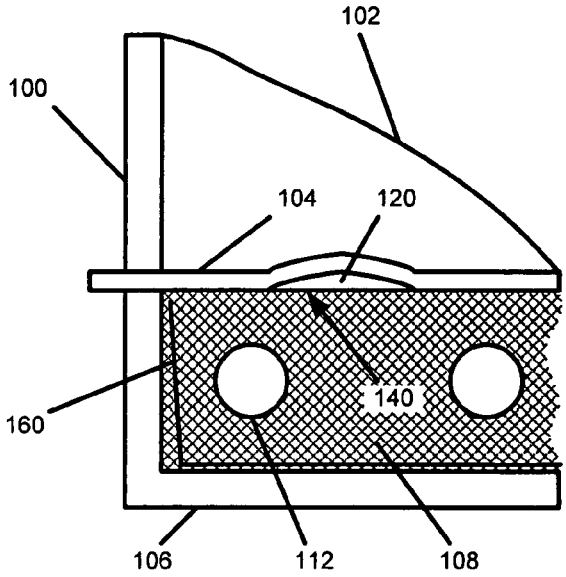
Figure 4A:
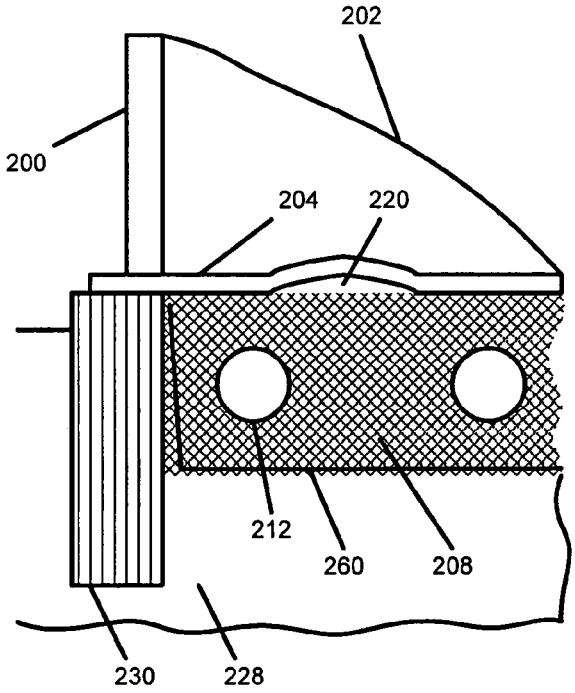
FIGS. 4A through 4D are a set of close-up illustrations of a storage tank that illustrate one embodiment of a synergistic corrosion management system in accordance with the present invention that is designed to protect the bottom surface of a storage tank.
Figure 4B:
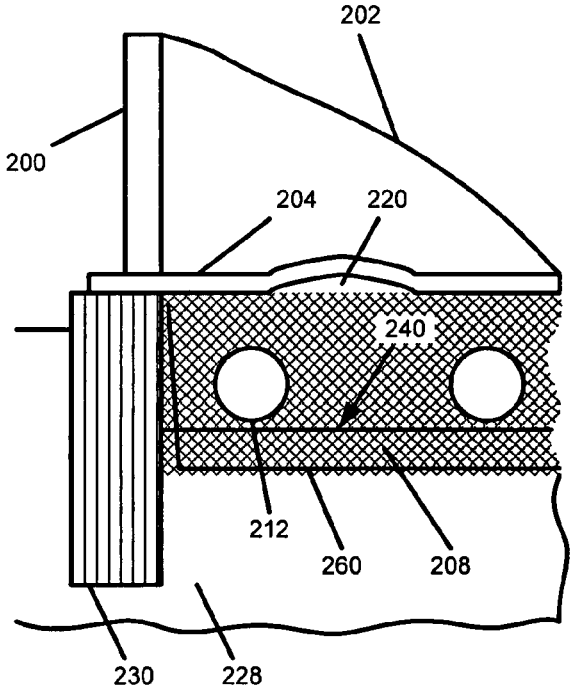
Figure 4C:
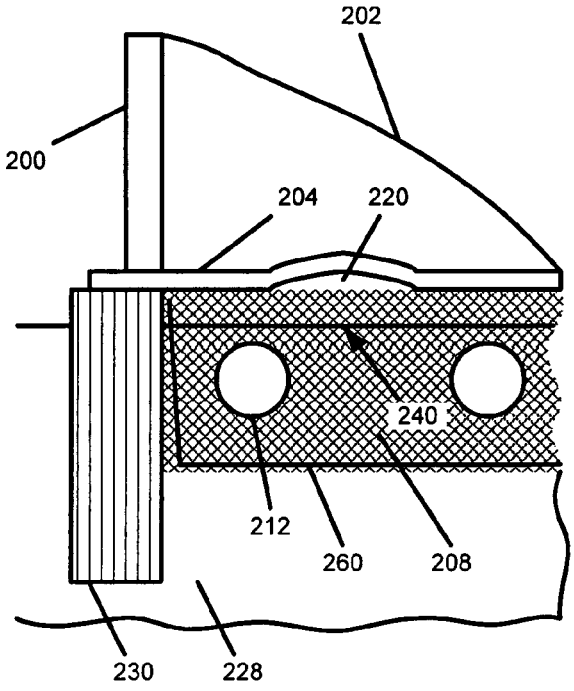
Figure 4D:
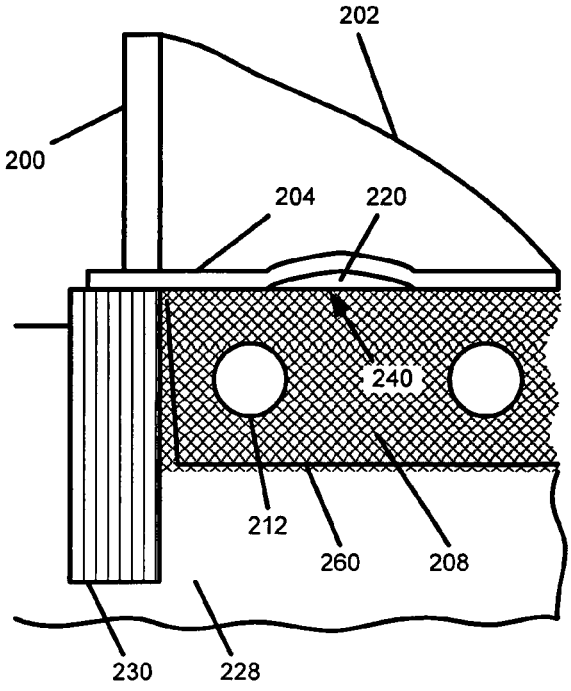
Figure 5A:
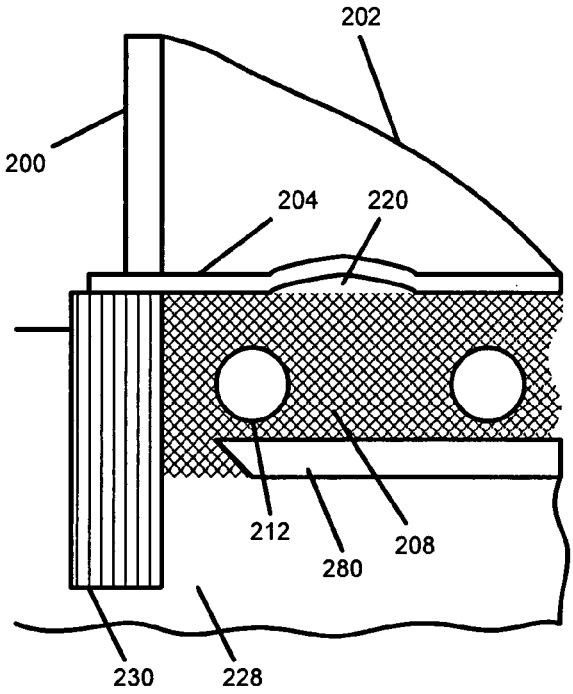
FIGS. 5A through 5D are a set of close-up illustrations of a storage tank that illustrate another embodiment of a synergistic corrosion management system in accordance with the present invention that is designed to protect the bottom surface of a storage tank.
Figure 5B:
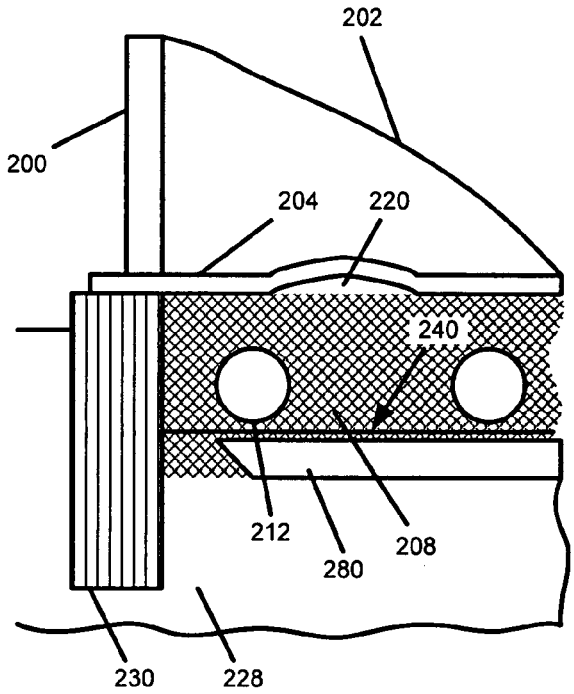
Figure 5C:
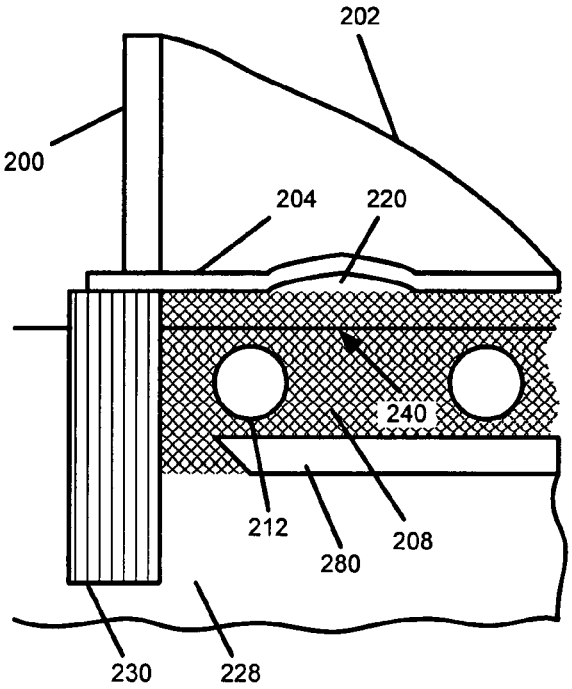
Figure 5D:
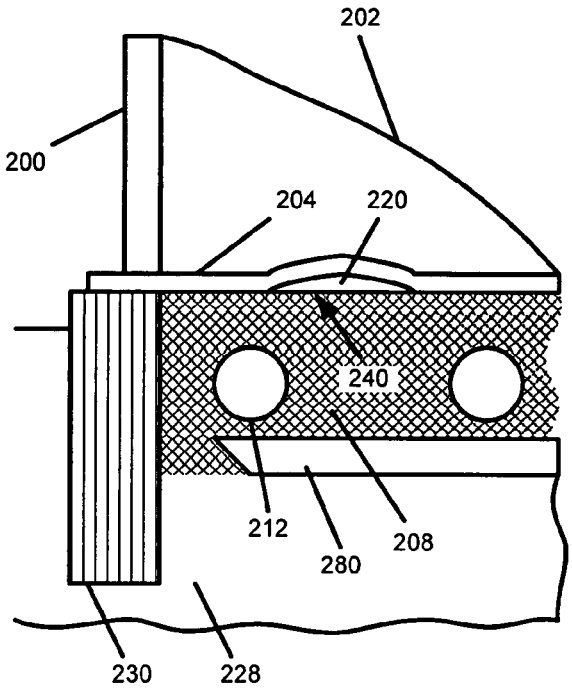

As can be seen from FIGS. 2B through 2D the level 140 of the combination of solvent and soluble corrosion inhibitor can vary as needed and/or dictated by the level of corrosion protection/mitigation necessary. Some factors which can dictate the amount of corrosion protection needed include, but are not limited to, whether or not the storage area 102 of tank 100 is filled, the nature of the material in the storage area 102, and the nature of the environment external to tank 100 (i.e., the humidity level, the temperature, the presence or absence of corrosive species such as, but not limited to, chlorine, salt, $NO_x$, $SO_x$, etc.).

Suitable soluble corrosion inhibitors include, but are not limited to, mixtures of $ZnSO_4$ and $NaH_2PO_4$, organic nitrites, and organic aminophosphites. Suitable solvents for such soluble corrosion inhibitors include, but are not limited to, aqueous solutions of sodium, potassium, and calcium compounds, or mixtures of two or more thereof. The strength and/or concentration of such aqueous solvents will depend, in part, upon the amount of soluble corrosion inhibitor to be dissolved therein. Accordingly, the present invention is not limited to any one set of strengths and/or concentrations of solvents for the soluble corrosion inhibitors disclosed herein. Suitable sodium and calcium compounds for use in forming the above-mentioned aqueous solvents include, but are not limited to, $Na_2MoO_4$, $ZnSO_4$, $Na_3PO_4$, $NaH_2PO_4$, $NaNO_2$, $Na_2SiO_3$, calcium phosphonate, imidazole, or suitable mixtures of two or more thereof. In another instance, corresponding potassium compounds can be used in place of the above-mentioned sodium compounds. In another embodiment, the one or more soluble corrosion inhibitors of the present invention are nano-sized powdered corrosion inhibitors made up of substantially spherical-shaped particles having an average diameter of less than about 2500 nanometers, less than about 1000 nanometers, less than about 500 nanometers, or even less than about 250 nanometers. However, the present invention is not limited to only the above-mentioned nano-sized powders. Rather, any nano-sized powder can be used herein regardless of particle geometry.

Any suitable volatile or vapor phase corrosion inhibitors can be used in conjunction with the above three-part system of the present invention taking into account the nature of the material to be protected. As such, the present invention is not limited to any one volatile or vapor phase corrosion inhibiting compound. Some suitable volatile or vapor phase corrosion inhibitors includes those disclosed in U.S. Pat. Nos. 4,290,912; 5,320,778; and 5,855,975, which are incorporated herein by reference in their entirety for their teachings of such compounds. For example, useful vapor phase or volatile corrosion inhibitors include, but are not limited to, benzotriazole, and mixtures of benzoates of amine salts with benzotriazole, nitrates of amine salts, $C_{13}H_{26}O_2N$, pyridine, imidazolines, imidazoles, amines (cyclohexylamine carbonate, benzylamine, etc.), phosphonates, nitrites (sodium, calcium, dicyclohexylamine), or suitable mixtures of two or more thereof.

Additionally, the combination of the one or more soluble corrosion inhibitors and the one or more volatile or vapor phase corrosion inhibitors should be compatible. That is, the compounds should not react detrimentally with one another.

In the case of the embodiment of FIGS. 2A through 2D, the one or more volatile or vapor phase corrosion inhibitors are supplied to the double bottom area 108 of tank 100 via any suitable supply means. Suitable supply means for delivering the initial and/or any subsequently needed volatile or vapor phase corrosion inhibitors to double bottom area 108 include, but are not limited to, servicing module 116 (FIG. 1), one or more supply pipes, periodic tank deliveries, capsule-based delivery systems, etc. In another embodiment, two or more delivery technologies are utilized. In one embodiment, the one or more volatile or vapor phase corrosion inhibitors are delivered periodically, or on an as needed basis, based on remote monitoring, human monitoring, computer-based monitoring, etc.

Given the combination of elements in the three-part systems of this embodiment, the present invention achieves previously unobtainable levels of protection for the metal, or metallic, surfaces that form and/or surround area 108. Such surfaces even include any irregularities and/or air pockets 120 that form in tank bottom 104 (i.e., the top surface 104 of the double bottom). This is because the combination of (1) at least one cathodic-based corrosion prevention or mitigation system; (2) at least one soluble corrosion inhibitor in a suitable solvent; and (3) at least one volatile corrosion inhibitor act to synergistically protect, in multiple manners, various portions of the bottom surfaces of the storage area of tank 100, as well as the double bottom of tank 100.

Turning to FIGS. 3A through 3D, another embodiment of a three-part synergistic corrosion management system for a tank double bottom is illustrated therein. In the embodiment of FIGS. 3A through 3D, the synergistic corrosion management system of the present invention utilizes a combination of: (1) at least one cathodic-based corrosion prevention or mitigation system (as is shown in FIG. 1 and partially represented by anodes 112 in FIG. 3); (2) at least one soluble corrosion inhibitor in a suitable solvent; and (3) at least one volatile corrosion inhibitor to protect area 108 of a double bottom tank 100.

With regard to the embodiment of FIGS. 3A through 3D, this embodiment is similar to those described above with reference to FIGS. 2A through 2D except that the embodiment of FIG. 3 further includes an insulating liner 160 to provide insulation to the cathodic system contained in area 108 of tank 100. As such, a detailed explanation of the embodiment of FIGS. 3A through 3D will be omitted for the sake of brevity.

In this embodiment, insulating liner 160 can be formed from any suitable material including, but not limited to, carbon, plastic, rubber, etc. In this embodiment, insulating liner 160 provides insulation for the at least one cathodic-based corrosion prevention or mitigation system included therein and permits such a system, or systems, to operate more efficiently. In another embodiment, insulating liner 160 is used in the case where tank 100 is being retrofitted with a three-part system in accordance with the present invention. In this embodiment, insulating liner 160 is used to cover the old bottom of the double bottom portion of the tank, or the old foundation of the tank, and serves to insulate the three-part synergistic system of the present invention against any potential problems (e.g., holes, pin holes, corrosion, etc.) that may exist in the existing bottom of the double bottom, or the foundation, of the tank. In still another embodiment, the use of insulating liner 160 permits the use a smaller number of anodes, thereby enabling one to realize various economic and design advantages in accordance with this embodiment.

Turning to FIGS. 4A through 4D, another embodiment of a three-part synergistic corrosion management system for a tank is illustrated therein. In the embodiment of FIGS. 4A through 4D, the synergistic corrosion management system of the present invention utilizes a combination of: (1) at least one cathodic-based corrosion prevention or mitigation system (as is shown in FIG. 1 and partially represented by anodes 212 in FIG. 4); (2) at least one soluble corrosion inhibitor in a suitable solvent; and (3) at least one volatile corrosion inhibitor to protect area 208 of a tank 200.

The main difference between the embodiments of FIGS. 2A through 3D and that of FIGS. 4A through 4D is that technically there is no double bottom in tank 200. Instead, tank 200 is formed on a suitable foundation material 228, which can optionally include weight bearing supports 230. The material used to form weight bearing supports 230 is not critical, although cement supports are typically favored for external storage tanks. With regard to foundation material 228, this material can be any type of material that is impervious to both the solvent used to dissolve the one or more soluble corrosion inhibitors and the supporting matter (e.g., sand, limestone, stone, carbon powder, etc.) that is used to fill area 208.

The remaining portions of tank 200 are a storage area 202 designed to store one or more liquids (e.g., oil, gas, etc.) therein, tank bottom 204, and anodes 212. Also included in this embodiment, is an insulating liner 260 that is similar in nature to line 160 described above. Insulating liner 260 acts identically to insulating liner 160 except for the lack of a metal, or metallic, surface there under (that is bottom surface 106).

Given the combination of elements in the three-part systems of this embodiment, the present invention achieves previously unobtainable levels of protection for the metal, or metallic, surfaces that form and/or surround area 208. Such surfaces even include any irregularities and/or air pockets 220 that form in tank bottom 204. This is because the combination of (1) at least one cathodic-based corrosion prevention or mitigation system; (2) at least one soluble corrosion inhibitor in a suitable solvent; and (3) at least one volatile corrosion inhibitor act to synergistically protect, in multiple manners, various portions of the bottom surfaces of the storage area of tank 200, as well as the bottom 204 of tank 200.

Turning to FIGS. 5A through 5D, another embodiment of a three-part synergistic corrosion management system for a tank is illustrated therein. In the embodiment of FIGS. 5A through 5D, the synergistic corrosion management system of the present invention utilizes a combination of: (1) at least one cathodic-based corrosion prevention or mitigation system (as is shown in FIG. 1 and partially represented by anodes 212 in FIG. 5); (2) at least one soluble corrosion inhibitor in a suitable solvent; and (3) at least one volatile corrosion inhibitor to protect area 208 of a tank 200.

With regard to the embodiment of FIGS. 5A through 5D, this embodiment is similar to those described above with reference to FIGS. 4A through 4D except that the embodiment of FIG. 5 further includes a volatile or vapor phase corrosion inhibitor-containing tray 280 and no insulating liner 260. As such, a detailed explanation of the embodiment of FIGS. 5A through 5D will be omitted for the sake of brevity.

In this embodiment, tray 280 supplies one or more volatile or vapor phase corrosion inhibitors to area 208 when the level 240 of soluble corrosion inhibitor and drops below the top of tray 280. As would be apparent to one of skill in the art, various features of this embodiment (tray 280) and various features of other embodiments (liner 160 or 260) can be combined to provide alternative combinations of the present invention.

Given the combination of elements in the three-part systems of this embodiment, the present invention achieves previously unobtainable levels of protection for the metal, or metallic, surfaces that form and/or surround area 208. Such surfaces even include any irregularities and/or air pockets 220 that form in tank bottom 204. This is because the combination of (1) at least one cathodic-based corrosion prevention or mitigation system; (2) at least one soluble corrosion inhibitor in a suitable solvent; and (3) at least one volatile corrosion inhibitor act to synergistically protect, in multiple manners, various portions of the bottom surfaces of the storage area of tank 200, as well as the bottom 204 of tank 200.

In light of the above, the three-part synergistic systems of the present invention can provide protection to a tank bottom, or double bottom, for a period of about 1 month to about 50 years. In another embodiment, the life expectancy of the devices of this portion of the present invention is from about 6 months to about 25 years, from about 1 year to about 15 years, or from about 2 years to about 10 years, or even from about 3 to about 5 years.

As can be seen from the graphs of FIGS. 6 through 10, the synergistic systems of the present invention provide a high level of protection based on the synergistic combinations of such three-part systems even when, as is shown in FIGS. 6 through 10, individual components thereof lose the effectiveness or operating efficiency. Accordingly, the present invention permits one to achieve overall corrosion protection levels in the bottoms, or double bottoms, of storage tanks that were, to date, previously unobtainable in single or two-part systems. This is due in large part to the complimentary effect of each portion of the three-part systems of the present invention.

Additional Protection of the Remaining Portions of an Enclosure

It should be noted that the above three-part systems for protecting tank bottoms, double bottoms, or some hybrid combination thereof can be combined with other corrosion management systems, where such additional systems are designed to protect one or more different portions of storage tanks.

Such additional corrosion management systems include the use of one or more corrosion inhibiting devices or capsules which can deliver at least one volatile corrosion inhibiting compound and/or at least one vapor phase inhibiting corrosion compound to an interior and/or top portion or environment of an enclosed tank (e.g., a storage tank, a gas tank, etc.).

Given the above, this portion of the present invention relates to devices or capsules which can be placed in tanks and/or containers which are constructed partially or totally from metal. The devices of this portion of the present invention are in general one or more closed or semi-closed (i.e., a device that can periodically opened for replenishment) devices, packages or capsules which contain therein one or more volatile or vapor phase corrosion inhibitors and are constructed from any suitable material, such as metal (e.g., stainless steel, aluminum, etc.) or a suitable polymeric material (e.g., polyolefin polymers such as polyethylene, polypropylene, ethylene/vinyl acetate copolymers, vinyl acetate/vinyl chloride copolymers and polyvinyl chloride). In another embodiment, the devices of this portion of the present invention are formed from structures that contain one or more layers of corrosion inhibiting films that are impregnated with, coated with, or contain one or more volatile or vapor phase corrosion inhibitors interspersed with layers of polymer films which contain no corrosion inhibitor.

Any suitable volatile or vapor phase corrosion inhibitors can be used in this portion of the present invention. U.S. Pat. Nos. 4,290,912; 5,320,778; and 5,855,975 disclose vapor phase or volatile corrosion inhibitors, and are incorporated herein by reference in their entirety for their teachings of such compounds. For example, useful vapor phase or volatile corrosion inhibitors include, but are not limited to, benzotriazole, and mixtures of benzoates of amine salts with benzotriazole, nitrates of amine salts, and $C_{13}H_{26}O_2N$.

In one embodiment, the one or more volatile or vapor phase corrosion devices of this additional portion of the present invention are designed to deliver at least one volatile corrosion inhibiting compound and/or at least one vapor phase inhibiting corrosion compound to an interior portion or environment of an enclosed tank and can be placed in such tanks, or storage enclosures, in a variety of manners. In one embodiment, the devices of this additional portion of the present invention are placed within the desired enclosure prior to filling the enclosure with the substance to be stored therein (e.g., gas, oil, water, etc.). In such an embodiment, this additional portion of the present invention can be free floating (i.e., able to move freely about the inside of the tank due to a neutral buoyancy), have a positive buoyancy so as to float at the top of the desired enclosure or have a negative buoyancy so as to sink either partially or completely to the bottom of the tank.

In another embodiment, the devices of this additional portion of the present invention can be attached by any suitable means to the bottom (or interior surface) of the desired enclosure and/or tank to be protected. Such attachment means include, but are not limited to, bolts, screws, rivets, chemical attachment means (e.g., glue, epoxy, etc.) or magnets. In another embodiment, if the devices of this additional portion of the present invention are formed either completely or partially from metal and the place where the devices are to be placed is suitable, the devices of this portion of the present invention can be welded into place.

In one embodiment, the attachment means is a magnet. A magnetic attachment means is advantageous in that it facilitates easy replacement and/or replenishment of the devices of this portion of the present invention should the volatile or vapor phase corrosion inhibiting portion thereof become exhausted.

In yet another embodiment, the devices of this additional portion of the present invention are incorporated into the cover and/or cap of a tank, container, semi-closed system or closed system in which corrosion protection is desired.

Thus, this additional portion of the present invention is primarily designed to protect against any one or more corrosive elements present in any gas atmosphere, or gaseous atmosphere, that is present within the interior of an enclosure, enclosed tank, storage tank, etc.

Given the above, the devices of this additional portion of the present invention permit the release of one or more volatile or vapor phase corrosion inhibitors into a desired closed or semi-closed environment over an extended period of time. Given that the devices according to this additional portion of the present invention can be, if so desired, replaced and/or replenished, the devices of this portion of the present invention do not have a set life expectancy. For example, the devices of this portion of the present invention could be designed to last any where from about 1 month to about 50 years. In another embodiment, the life expectancy of the devices of this portion of the present invention is from about 6 months to about 25 years, from about 1 year to about 15 years, or from about 2 years to about 10 years, or even from about 3 to about 5 years. It will be apparent to one of ordinary skill in the art, upon reading the present specification, that the devices according to this portion of the present invention could be produced with an indefinite range of life expectancies. As such, this portion of the present invention is not limited to the above life expectancies. Rather, one of ordinary skill in the art would, upon reading the present specification and taking into consideration the environment in which the device will be placed, be able to design a device for this portion of the present invention with any desired life expectancy.

The devices of this additional portion of the present invention deliver one or more volatile or vapor phase corrosion inhibitors to the environment in which they are placed by any suitable delivery means. Such delivery means include, but are not limited to, one way diaphragms, two way diaphragms, semi-permeable membranes, valves (e.g., pressure sensitive valves, electronic valves, etc.) which allow the passage of corrosion inhibitor out of the device but prevent the inflow of the liquid or vapor phase environment which surrounds the device, a decomposable metal or polymeric plug or a decomposable corrosion inhibitor impregnated polymer film. In another embodiment, if an electronic valve is incorporated into the devices of this portion of the present invention, the electronic valve can be constructed and/or programmed so as to release corrosion inhibitor at regular intervals and/or in regular amounts. For example, an electronic valve could be set to release corrosion inhibitor from a device according to this portion of the present invention once every day, week, month or year. Alternatively, an electronic valve could be set to release corrosion inhibitor every other day, week, month or year. It should be noted, that this portion of the present invention is not limited to any one interval scheme. Rather, if incorporated in the devices according to this portion of the present invention, an electronic valve can be set to dispense corrosion inhibitor at any given regular or irregular interval.

In another embodiment, the devices of this additional portion of the present invention can contain therein a sensor for detecting the concentration of various corrosive environments. In response to a certain threshold pressure or concentration of corrosive gas, corrosive liquid, corrosive ions, etc., the sensor instructs the electronic valve to release corrosion inhibitor for a certain amount of time. In another embodiment, the electronic valve is equipped with a flow meter and can dispense any desired amount of corrosion inhibitor (be it liquid or gas). Such an electronic valve is useful in situations where a known amount of corrosive material collects (or forms) over a given period of time.

In yet another embodiment, the devices of this additional portion of the present invention can incorporate therein dissolvable or degradable plugs which dissolve or degrade in the presence of one or more corrosive elements over time or dissolve or degrade in a given environment. For example, a plug could be designed to degrade in the presence of water, water vapor, or water condensation thereby permitting the release corrosion inhibitor into the interior of an enclosure or storage tank. In another embodiment, the degradable plug could be made of a metal which breaks down quickly in the presence of oxygen (e.g., magnesium).

This additional portion of the present invention will now be described in relationship to specific embodiments as shown in the attached Figures. It should be noted that this additional portion of the present invention is not only limited to those embodiments shown in the attached Figures. Rather, this portion, and any other portion, of the present invention should be broadly construed. In the Figures, like reference numerals refer to like parts.

Figure 11:
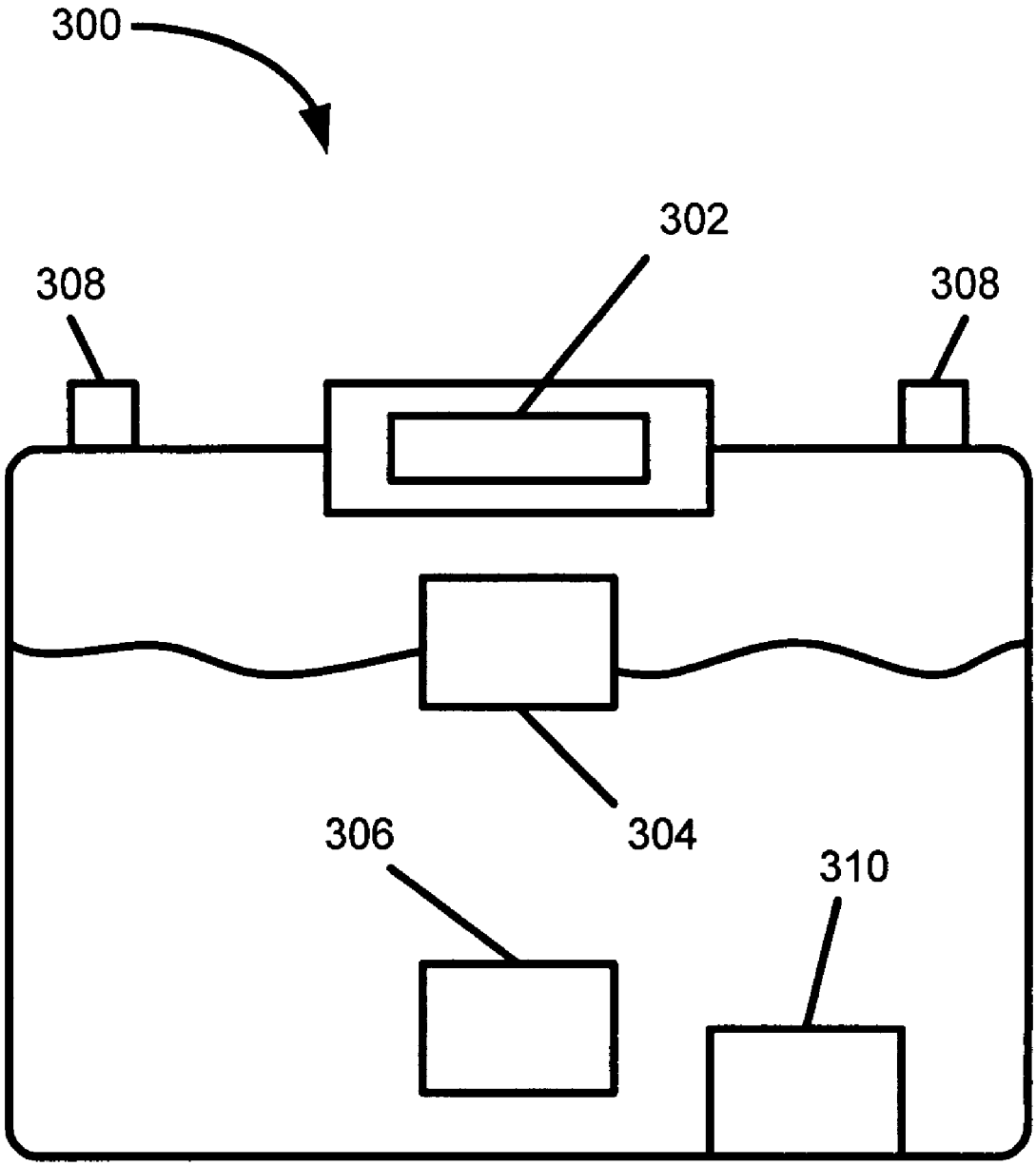
FIG. 11 illustrates a number of additional devices according to numerous embodiments of one portion of the present invention which have been placed into a tank in order to provide increased corrosion protection to other portions of a storage tank.

Referring to FIG. 11, a general depiction of this portion of this additional portion of the present invention is shown. As shown in FIG. 11, a tank 300 contains (represented by reference numerals 304 and/or 306) therein one or more additional devices according to this portion of the present invention. The tank further includes a hatch, cap, cover or lid that can contain one or more volatile or vapor phase corrosion inhibitor-based devices 302. In another embodiment, additional volatile or vapor phase corrosion inhibitor-based devices 308 can be installed along the top surface of tank 300 to provide corrosion protection to any vapor space that may exist at the top of tank 300. In this embodiment, devices 308 provide at least one volatile or vapor phase corrosion inhibitor to the interior of tank 300 and can be easily serviced or replenished based on the external location of devices 308.

In still another embodiment volatile or vapor phase corrosion inhibitor-based devices 308 could be installed on the interior top surface of the internal portion of a storage tank in order to provide protection to any vapor space that may exist at the top of tank 300 (not shown), even if such top surface is a floating top. However, as would be apparent to those of skill in the art, servicing of devices 308 in this embodiment would be more difficult.

In one embodiment, the devices of this portion of the present invention can be secured to any portion of the interior wall of the tank (e.g., a side wall, the top or the bottom) by any suitable means (e.g., epoxy, welding, rivets, screws, bolts, magnets, etc.) (device 310 of FIG. 11). In another embodiment, the devices of this portion of the present invention can be permitted to float within the confines of tank 300 (devices 304 and 306 of FIG. 11). In still another embodiment, the devices of this portion of the present invention can be designed so as to reside within the lid, cap, cover or hatch of the tank 300 (device 302 of FIG. 11). In yet another embodiment, any combination of secured devices 310, free floating devices 304 and 306, cap devices 302, and external top and/or internal top devices 308 can be utilized in tank 300.

In still another embodiment, multiple volatile or vapor phase corrosion devices can be secured to an exterior portion (e.g., the roof), or interior portion (e.g., a wall) of a tank, or other semi-closed or closed system, thereby providing added protection to any metal, or metallic, surface that is in contact with a gas, or gaseous, atmosphere that contains at least one corrosive compound contained therein.

With regard to tank 300, although tank 300 is shown as a single-walled tank, tank 300 is not limited thereto. Rather, tank 300 is to be seen as representative of any type of tank. Such tanks include, but are not limited to, double-walled tanks, single-walled, double- or single-walled tanks with double bottoms, etc.

As will be apparent from the following discussion, devices 302, 304, 306, 308 and 310 can be selected, as needed, from any one or more of devices 400, 400*a*, 400*b*, 400*c*, 500*a*, 500*a*', 500*b*, 500*c*, 500*d*, 600*a*, 600*b*, 600*c*, 700*a*, 700*b*, 700*c*, 800*a*, 800*b*, 800*c*, 1100*a*, and/or 1100*b* of this portion of the present invention as discussed below in connection with the various Figures. In yet another embodiment, a device according to this portion of the present invention can actually be a tank lid, cap, cover or hatch which contains therein at least one corrosion inhibitor and a delivery means. It should be noted that this portion of the present invention is not limited to just these embodiments; rather features from different embodiments can be combined to yield additional embodiments which, although not depicted, are within the scope of this portion of the present invention.

Turning to FIGS. 12A to 12D, FIG. 12A depicts a device 400 according to another embodiment of this portion of the present invention. Device 400 includes a capsule 402 formed from any suitable non-degradable and/or corrosion resistant material. In one embodiment, capsule 402 is formed from any suitable metal (e.g., stainless steel, aluminum, etc.). In another embodiment, capsule 402 is formed from a suitable non-degradable polymer composition (e.g., a polyolefin polymer). The inside of capsule 402 includes one or more suitable volatile or vapor phase corrosion inhibitor 404 which is selected based upon the corrosive element or compound to be neutralized. Capsule 402 has therein one or more openings 406 which are sealed with a degradable plug or cap 408. Upon exposure to a corrosive environment or corrosive element in an environment, the one or more degradable plugs or caps 408 degrade to allow the volatile or vapor phase corrosion inhibitor 404 contained in device 400 to exit capsule 404 and neutralize the one or more corrosive elements that may exist outside device 400.

In one embodiment, each degradable plug or cap 408 is independently formed from any suitable material, such as a bio-degradable polymer composition, a polymer composition which is soluble in a given environment (e.g., a water soluble or oil soluble polymer) or a metal material which degrades or corrodes when exposed to a specific chemical compound (e.g., magnesium metal which reacts in the presence of oxygen). Upon exposure to a suitable element and/or environment, degradable plug or cap 408 degrades thereby allowing volatile or vapor phase corrosion inhibitor 404 to escape through opening 406. It will be appreciated by those of skill in the art, that degradable plug or cap 408 can be designed so as to resist a certain amount of degradation prior to permitting the volatile or vapor phase corrosion inhibitor contained in device 400 from escaping. That is, degradable plug or cap 408 may be designed so as to retain integrity (i.e., to not permit the escape of any amount of volatile or vapor phase corrosion inhibitor contained in the device) for any desired period of time. In one embodiment, degradable plug or cap 408 is designed to retain integrity for about 1 hour to about 1 month, or from about 10 hours to about 2 weeks, or even from about 2 days to about 1 week.

Figure 12A:
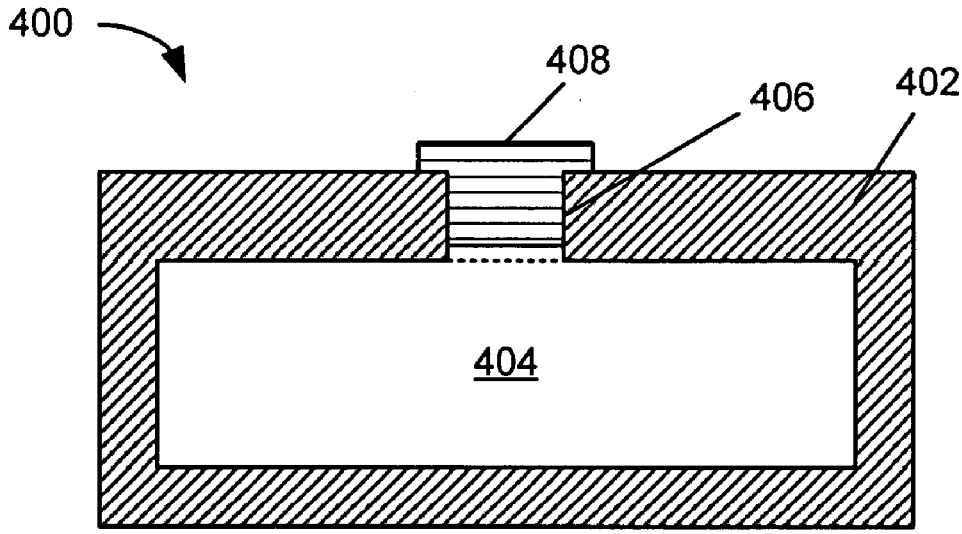
FIGS. 12A, 12B, 12C, 12C' and 12D are cross-sectional views which illustrate four different embodiments of another type of a volatile or vapor phase corrosion inhibitor system according to the present invention for use in combination with the synergistic systems of the present invention.
Figure 12B:
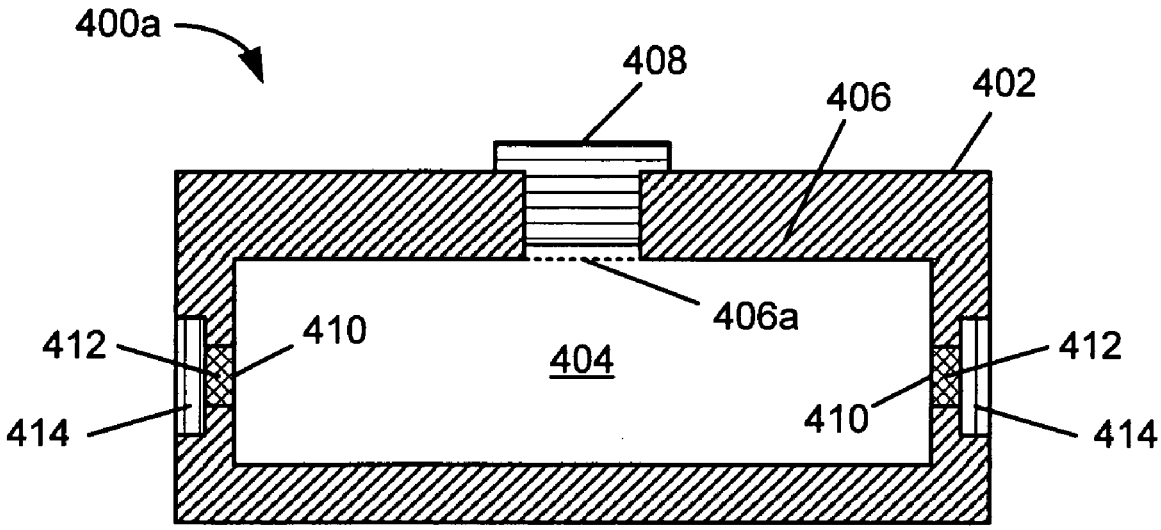

Referring to FIG. 12B, FIG. 12B depicts one variation of device 400 of FIG. 12A. As shown in FIG. 12B, device 400*a*, which is similar to device 400 shown in FIG. 12A, includes a capsule 402 formed from any suitable material, at least one volatile or vapor phase corrosion inhibitor 404, an opening 406, and a plug or cap 408*a*. In this embodiment, plug or cap 408*a* may be formed from any suitable degradable or non-degradable material (e.g., a non-degradable polymer or suitable metal such as aluminum or stainless steel). If plug or cap 408*a* is formed from a non-degradable material, opening 406 can serve as a means by which to fill capsule 402 with volatile or vapor phase corrosion inhibitor 404 with the dashed line 406*a* in FIG. 12B representing a diaphragm valve through which corrosion inhibitor 404 can be deposited into capsule 402 by using, for example, a syringe. Alternatively, the opening in capsule 402 represented by dashed line 406*a* need not be present.

Device 400*a* further includes one or more openings 410 (two are pictured in FIG. 12B) in capsule 402. Each opening 410 is sealed with a suitable valve 412 (for example, a one-way or two-way diaphragm valve). A degradable cover 414 is placed over each valve 412 to prevent the undesired or untimely escape of volatile or vapor phase corrosion inhibitor 404 from capsule 402. The composition of degradable cover 414 is similar in nature to that of degradable plug or cap 408. As such, further discussion is hereby omitted.

Figure 12C:
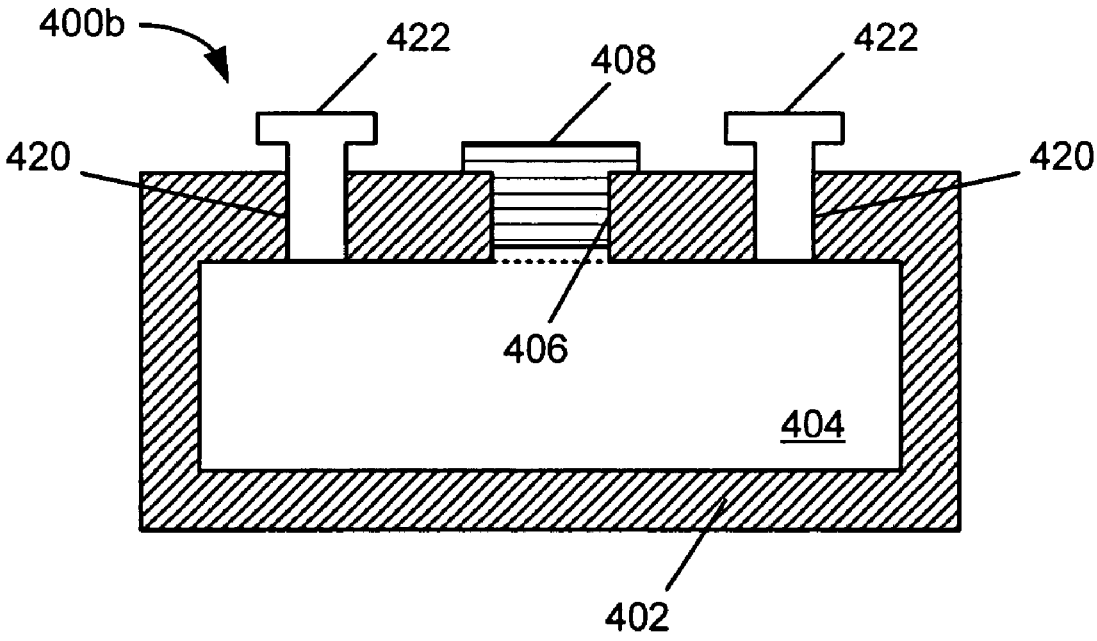
Figure 12C:
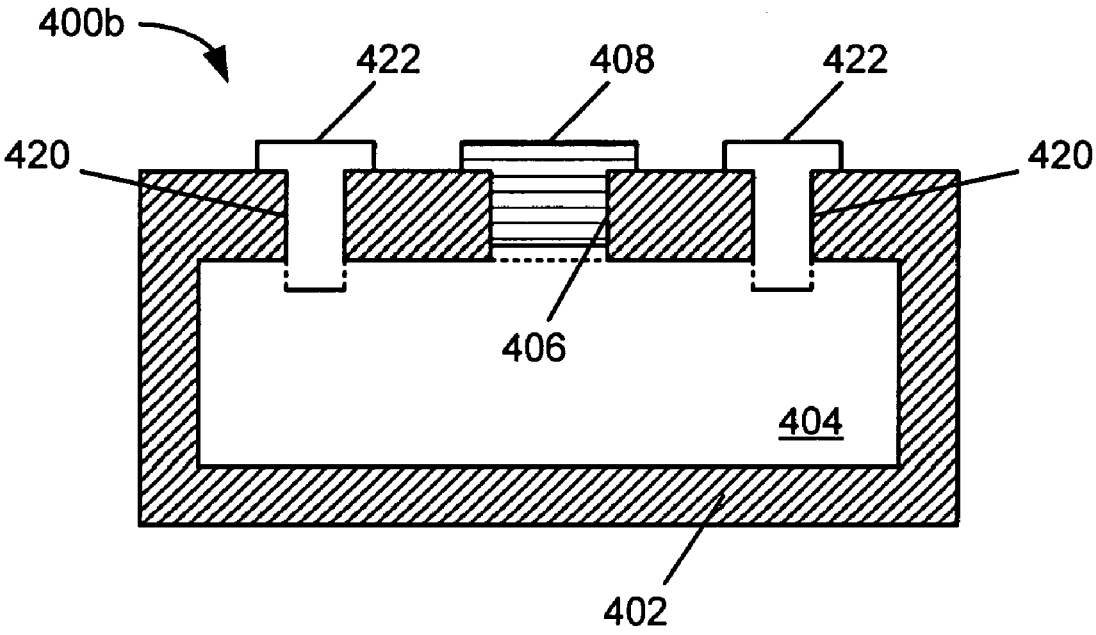

Referring to FIGS. 12C and 12C', a device 400*b* is depicted which includes a capsule 402 formed from any suitable material, at least volatile or vapor phase one corrosion inhibitor 404, an opening 406, and a plug or cap 408*a*. In this embodiment, plug or cap 408*a* may be formed from any suitable degradable or non-degradable material (e.g., a non-degradable polymer or suitable metal such as aluminum or stainless steel). Device 400*b* further includes one or more openings 420 which contained therein a sealable one way vent or valve 422. When in the open position (FIG. 12C'), the one way vent or valve 422 allows volatile or vapor phase corrosion inhibitor 404 to escape from capsule 402 into the surrounding environment (i.e., the inside of a tank, container, semi-closed system or closed system). Depending upon the environment in which device 400*b* is placed; one way vent or valve 422 can either be manually or automatically controlled. Such automatic venting systems and valves are known in the art and a discussion thereof is omitted.

Figure 12D:
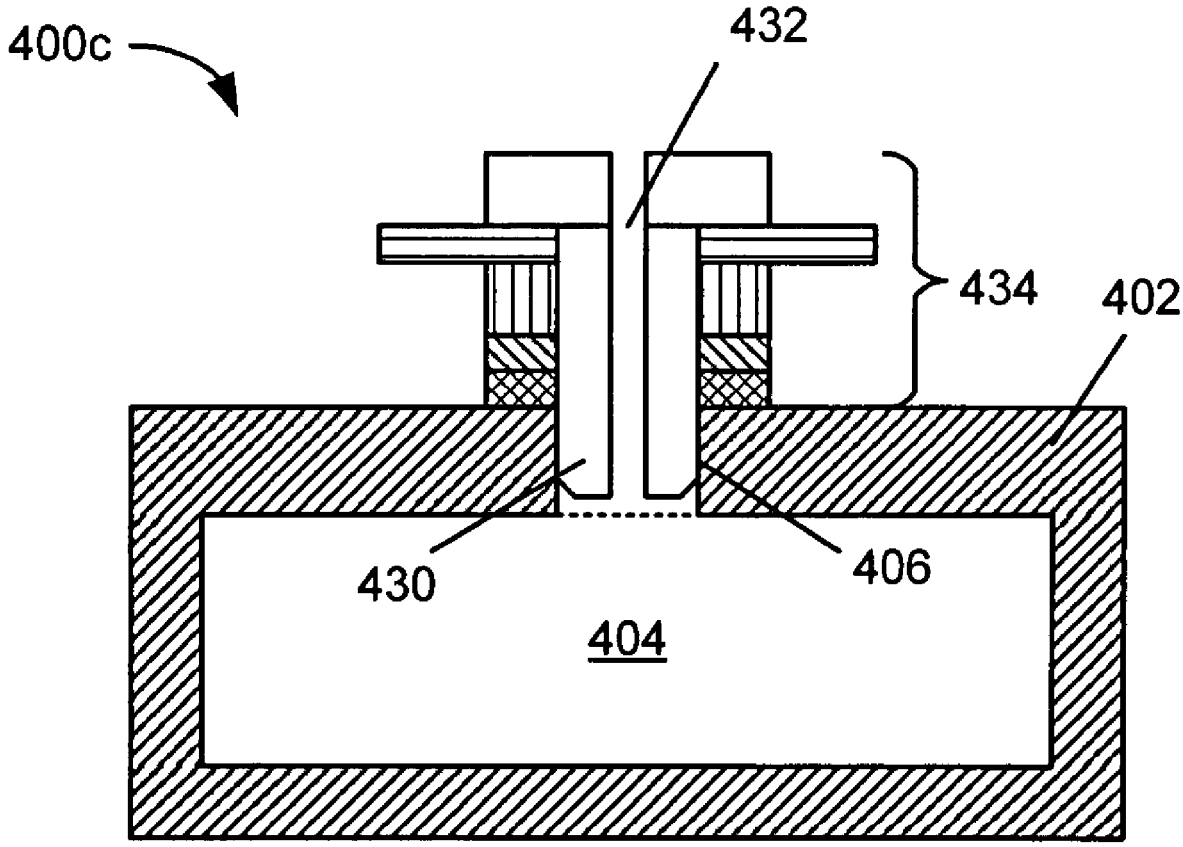

In another embodiment, the degradable plug or cap 408 of device 400 of FIG. 12A can be replaced by a diaphragm valve 430 which can be constructed so that the diaphragm valve 430 can be opened and closed either manually or automatically (see FIG. 12D). In one embodiment, device 400 can be sized accordingly to fit into the top portion of a gas tank cap, tank or container lid, or a hatch (see device 400*c* of FIG. 12D). In this case, the release of volatile or vapor phase corrosion inhibitor 404 into the enclosed environment inside the tank, container, pipeline, semi-closed system or closed system can be controlled manually from outside of the tank, container, semi-closed system or closed system. For example, in a gas tank cap, capsule 402 of device 400*c* is placed into the top portion of the cap and a vent 432 is formed through the shank 434 (be it threaded or otherwise) of the gas cap in order to permit volatile or vapor phase corrosion inhibitor 404 to escape from device 400*c* into the gas tank as needed or on a timed basis.

In general the devices described above with reference to FIGS. 12A to 12D are intended to be placed inside of a tank, container, semi-closed system or closed system. Alternatively, such devices can be designed to fit into, if present, the lid, cover and/or hatch of any tank, container, semi-closed system or closed system. Any of these devices can further be attached permanently or semi-permanently to the inside of a tank, container, semi-closed system or closed system via any suitable means (e.g., rivets, screws, bolts, welded, etc.).

Figure 13A:
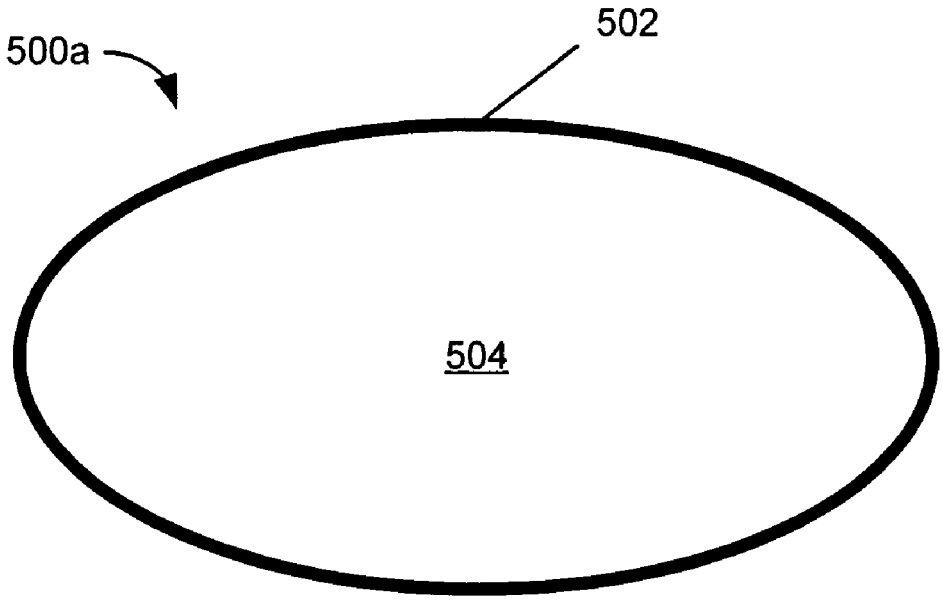
FIGS. 13A, 13B, 13C, 13D and 13E are cross-sectional views which illustrate five different embodiments of still another type of a volatile or vapor phase corrosion inhibitor system according to the present invention for use in combination with the synergistic systems of the present invention.
Figure 13B:
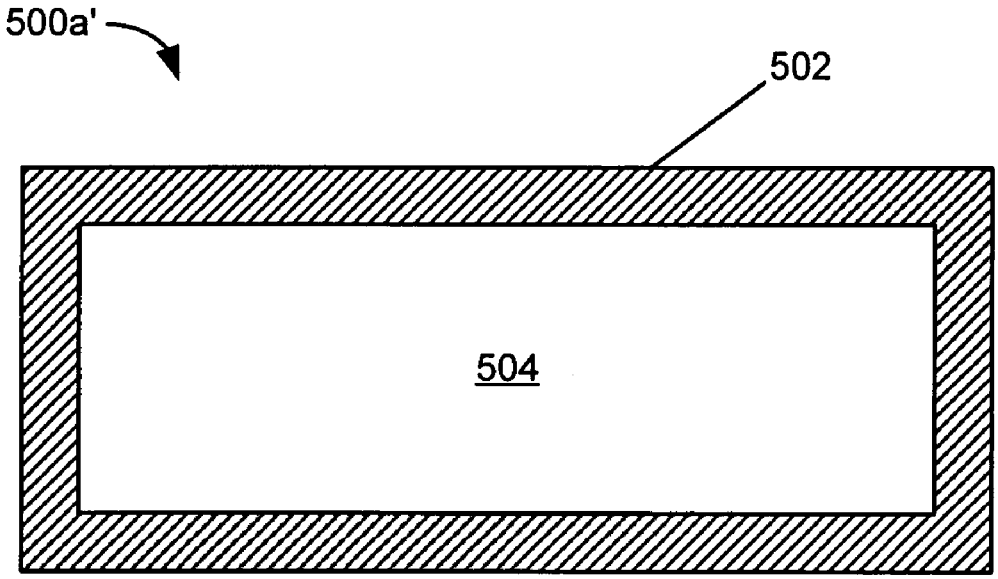

Referring to FIGS. 13A and 13B, devices 500*a* and 500*a*' are shown. In FIG. 13A, device 500*a* is formed from any suitable degradable material, as described above, which has been formed into a capsule 502 which contains at least one volatile or vapor phase corrosion inhibitor 504. Volatile or vapor phase corrosion inhibitor 504 may also contain one or more other corrosion inhibitors, such as an inert gas (e.g., helium).

Given the intended use, capsule 502 may be of any shape or size as required. As shown in FIGS. 13A and 13B, capsule 502 may be elliptical or rectangular in shape, respectively. In the case where capsule 502 is formed from a degradable polymeric composition, the capsule 502 may be formed by any suitable technique including, but not limited to, extrusion, coextrusion, blow molding, casting or injection molding. In one embodiment, the capsule 502 can be formed from polymeric films which are joined through any suitable technique (e.g., heat sealed) to form the desired shape. In the case where capsule 502 is formed from a degradable metal (or a metal which corrodes easily), the capsule 502 may be formed by any suitable technique including, but not limited to, casting or injection molding.

Upon being exposed to a corrosive environment or element in a tank, container, semi-closed system or closed system, capsule 502 undergoes degradation over time and releases into the environment volatile or vapor phase corrosion inhibitor 504. As noted above, devices 500*a* and 500*a*' can be designed so as to retain their initial integrity over any given period of time. In another embodiment, devices 500*a* and 500*a*' further include a magnet (not pictured) for securing the device to any desired magnetic surface (e.g., the interior surface of a metallic storage tank).

Figure 13C:
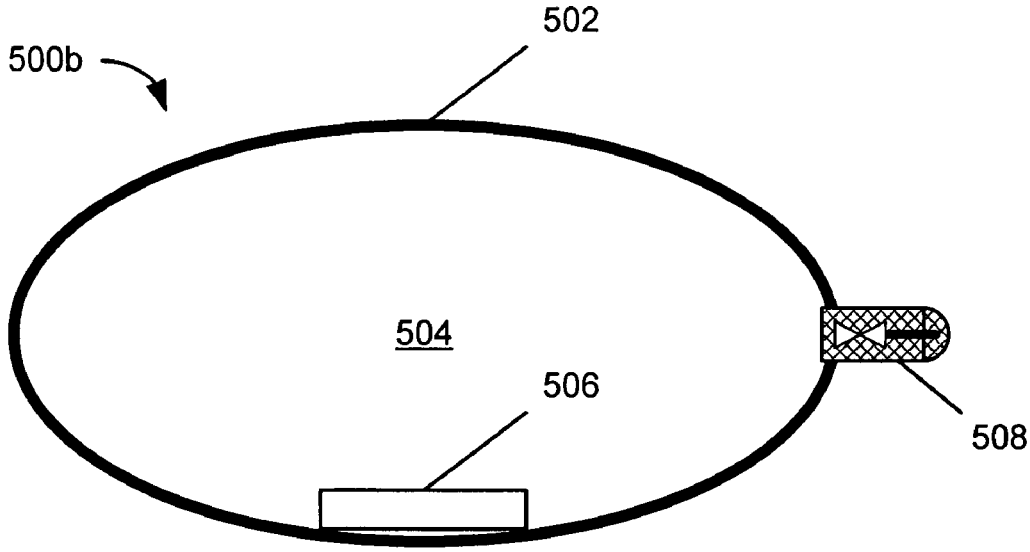
Figure 13D:
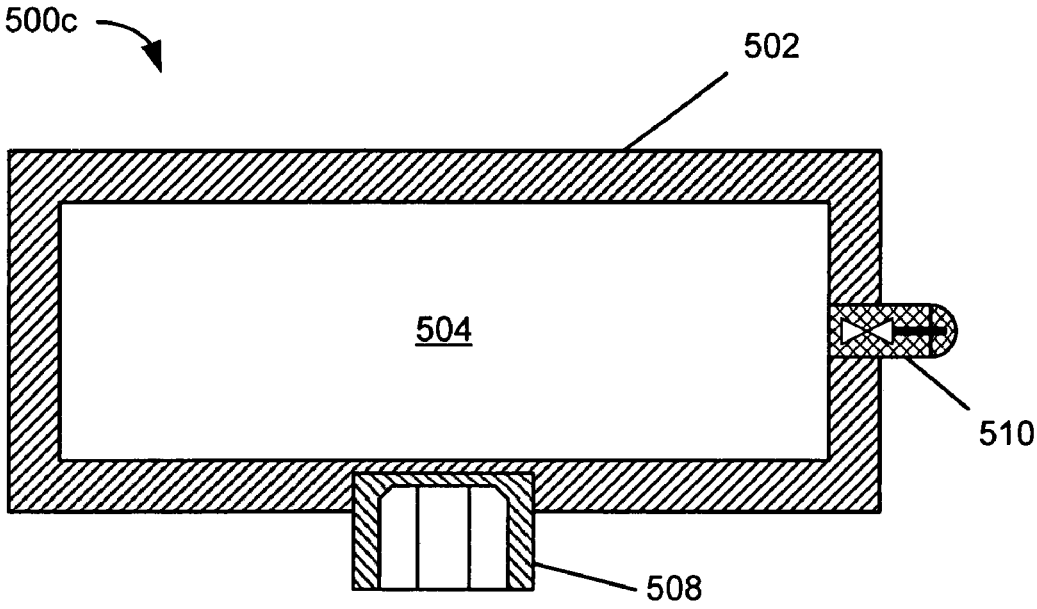

Referring to FIGS. 13C and 13D, FIGS. 13C and 13D depict two possible variations of devices 500*a* and 500*a*'. As shown in FIG. 13C, device 500*b*, which is similar to device 500*a* shown in FIG. 13A, includes a capsule 502 formed from any suitable material, at least one volatile or vapor phase corrosion inhibitor 504, and a magnet 506. In this case, device 500*b* also includes a diaphragm valve 508 which permits volatile or vapor phase corrosion inhibitor 504 to escape from capsule 502 into the surrounding environment. In one embodiment, diaphragm valve 508 permits the controlled release of volatile or vapor phase corrosion inhibitor 504 during the time in which it takes capsule 502 to lose its integrity and release the remaining volatile or vapor phase corrosion inhibitor 504. The magnet 506 can either be placed inside of capsule 502 (see FIG. 13B) or can be placed within the wall of capsule 502 (not shown). If the magnet 506 is placed inside of capsule 502, it is kept in place along the wall of capsule 502 by any suitable means (e.g., glue, epoxy, welding, etc.).

In another embodiment, capsule 502 can be formed from a non-degradable material and retain its structural integrity for any extended period of time (i.e., for more than 1 month). In one embodiment, capsule 502 can retain its structural integrity for about 1 month to about 50 years, or from about 6 months to about 25 years, or even from about 1 year to about 5 years. In this instance, diaphragm valve 508 can be any suitable valve which can be used to release volatile or vapor phase corrosion inhibitor 504 on regular intervals or on an as needed basis. In still another embodiment, valve 508 can be used to replenish the volatile or vapor phase corrosion inhibitor contained within capsule 502 once capsule 502 has become depleted. In such a case, a two way valve or a self-sealing diaphragm can be utilized for valve 508.

Alternatively, as is shown in FIG. 13D, if capsule 502 is formed from a non-degradable material, two or more valves can be included therein. In such a case at least one diaphragm valve 508 discharges, as desired, volatile or vapor phase corrosion inhibitor 504 into the surrounding environment, and at least one valve 510 can be utilized to replenish the volatile or vapor phase corrosion inhibitor 504 within capsule 502 once it has been expended.

Figure 13E:
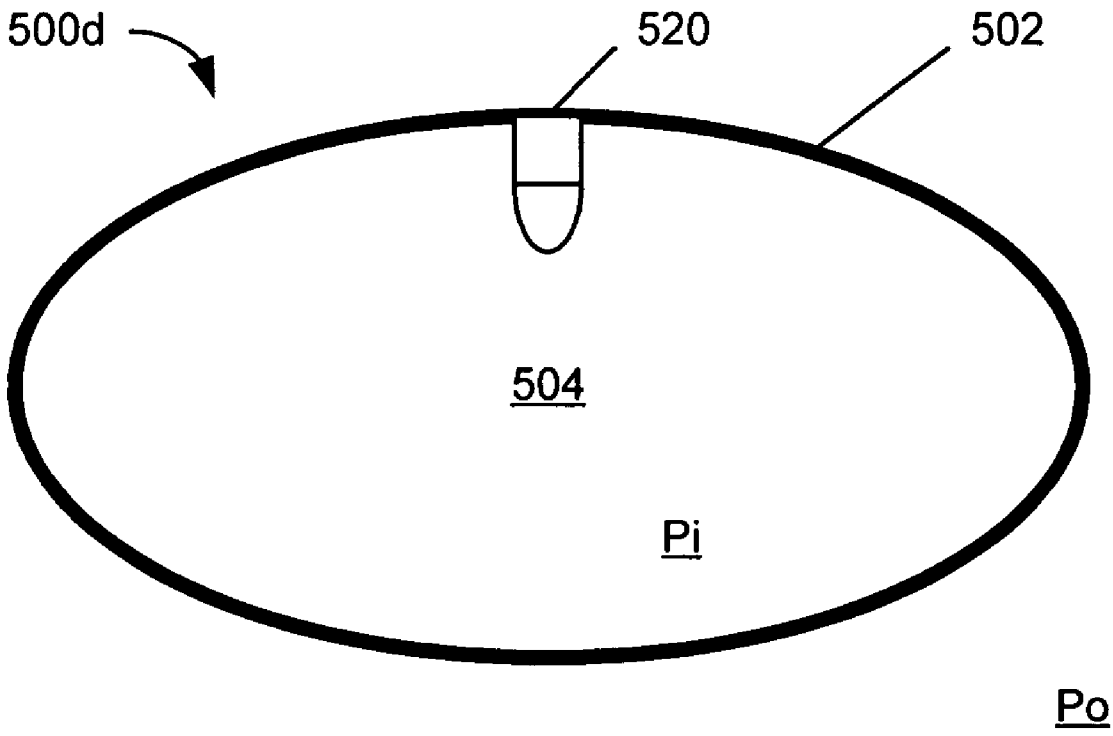

Referring to FIG. 13E, FIG. 13E depicts another possible variation of devices 500*a*, 500*a*', 500*b* and 500*c*. As shown in FIG. 13E, device 500*d*, which is similar to device 500*a* shown in FIG. 13A, includes a capsule 502 formed from any suitable material and at least one volatile or vapor phase corrosion inhibitor 504. In this case, device 500*d* also includes a one way nipple valve 520 which permits volatile or vapor phase corrosion inhibitor 504 to escape from capsule 502 into the surrounding environment when certain pressure criteria are met. For instance when the pressure outside ($P_o$) capsule 502 is less than or equal to the pressure within ($P_i$) capsule 502, then the one way nipple valve 520 is actuated and releases volatile or vapor phase corrosion inhibitor 504. Conversely, when the pressure outside ($P_o$) capsule 502 is greater than the pressure within ($P_i$) capsule 502, then the one way nipple valve 520 remains sealed and volatile or vapor phase corrosion inhibitor is not released into the surrounding environment. Device 500*d* is useful in situations where the cost of the delivery system for the corrosion inhibitor 504 is to be kept at a minimum since device 500*d* functions due to a difference in exterior versus interior pressure. In FIG. 13D, one way nipple valve 520 is shown in the open state.

Figure 14A:
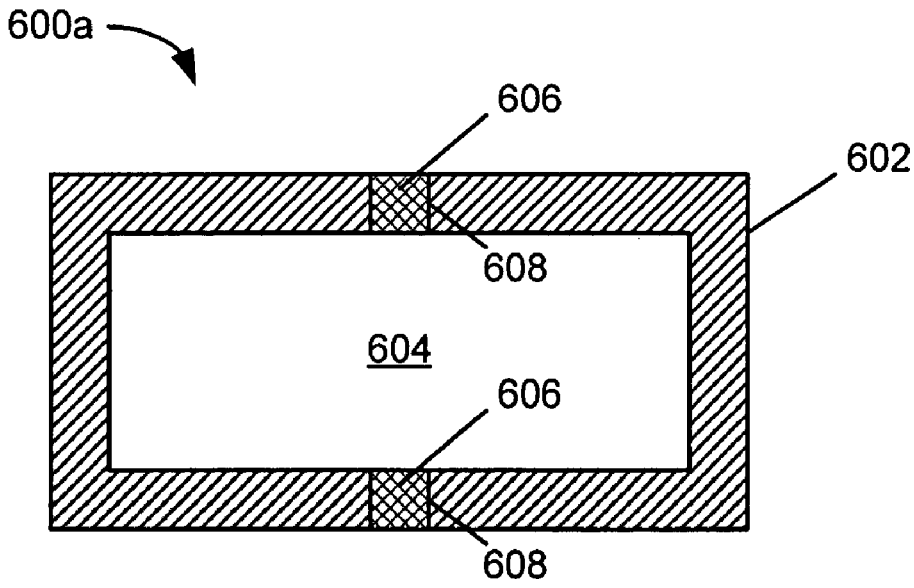
FIGS. 14A, 14B and 14C are cross-sectional views which illustrate three different embodiments of still another type of a volatile or vapor phase corrosion inhibitor system according to the present invention for use in combination with the synergistic systems of the present invention.

Referring to FIG. 14A, device 600*a* is shown. Device 600*a* includes a capsule 602 formed from any suitable non-degradable and/or corrosion resistant material. In one embodiment, capsule 602 is formed from any suitable metal (e.g., stainless steel, aluminum, etc.). In another embodiment, capsule 602 is formed from a suitable non-degradable polymer composition (e.g., a polyolefin polymer). The inside of capsule 602 includes at least one suitable volatile or vapor phase corrosion inhibitor 604 which is selected based upon the corrosive element or compound to be neutralized. Capsule 602 has therein one or more degradable plugs 606 (two plugs are shown). Degradable plugs 606 can be formed from a degradable polymer composition or, alternatively, a metallic composition (e.g., magnesium, zinc or aluminum) which will degrade or react upon exposure to a given corrosive element or environment. Such degradation or reaction creates one or more openings 608 through which volatile or vapor phase corrosion inhibitor 606 can escape from capsule 602. The choice of the composition used for plugs 606 depends upon the corrosive element or environment in which device 600*a* is to be utilized. In another embodiment, device 600*a* can further include a valve 610 which can be used to replenish the volatile or vapor phase corrosion inhibitor 604 contained within capsule 602. Such a device is, for example, depicted in FIG. 14B.

Figure 14B:
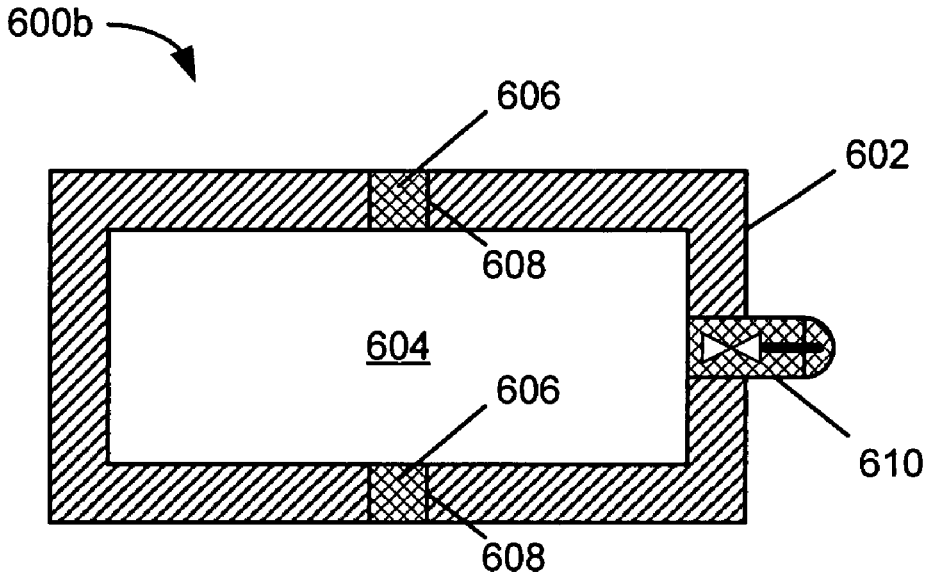

Referring to FIG. 14B, FIG. 14B depicts a device 600*b* which is similar in nature to device 600*a* of FIG. 14A except for the inclusion of valve 610. Device 600*b* can be reused by replacing degradable plugs 606 and then utilizing valve 610 to refill capsule 602 with volatile or vapor phase corrosion inhibitor 604. In still another embodiment, device 600*b* further includes a diaphragm valve 612 which can be used to release, on a controlled basis, corrosion inhibitor 604 prior to degradation of degradable plugs 606. Such a device is, for example, depicted in FIG. 14C.

Figure 14C:
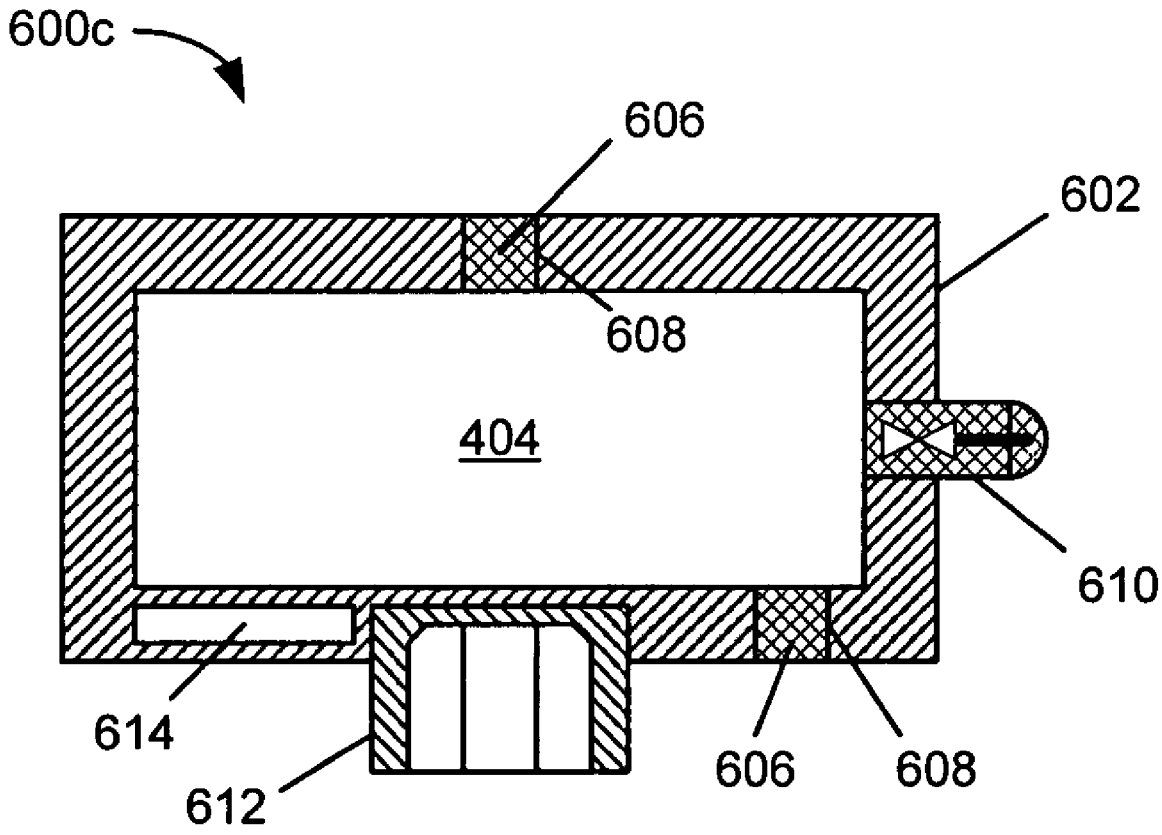

FIG. 14C depicts a device 600*c* which is similar in nature to device 600*b* of FIG. 14B except for the inclusion of diaphragm valve 612. In yet another embodiment, an optional magnet 614 can be placed within the structure of capsule 602 (or even inside capsule 602). In yet another embodiment, device 600*c* can just include diaphragm valve 612 and not valve 610.

Figure 15A:
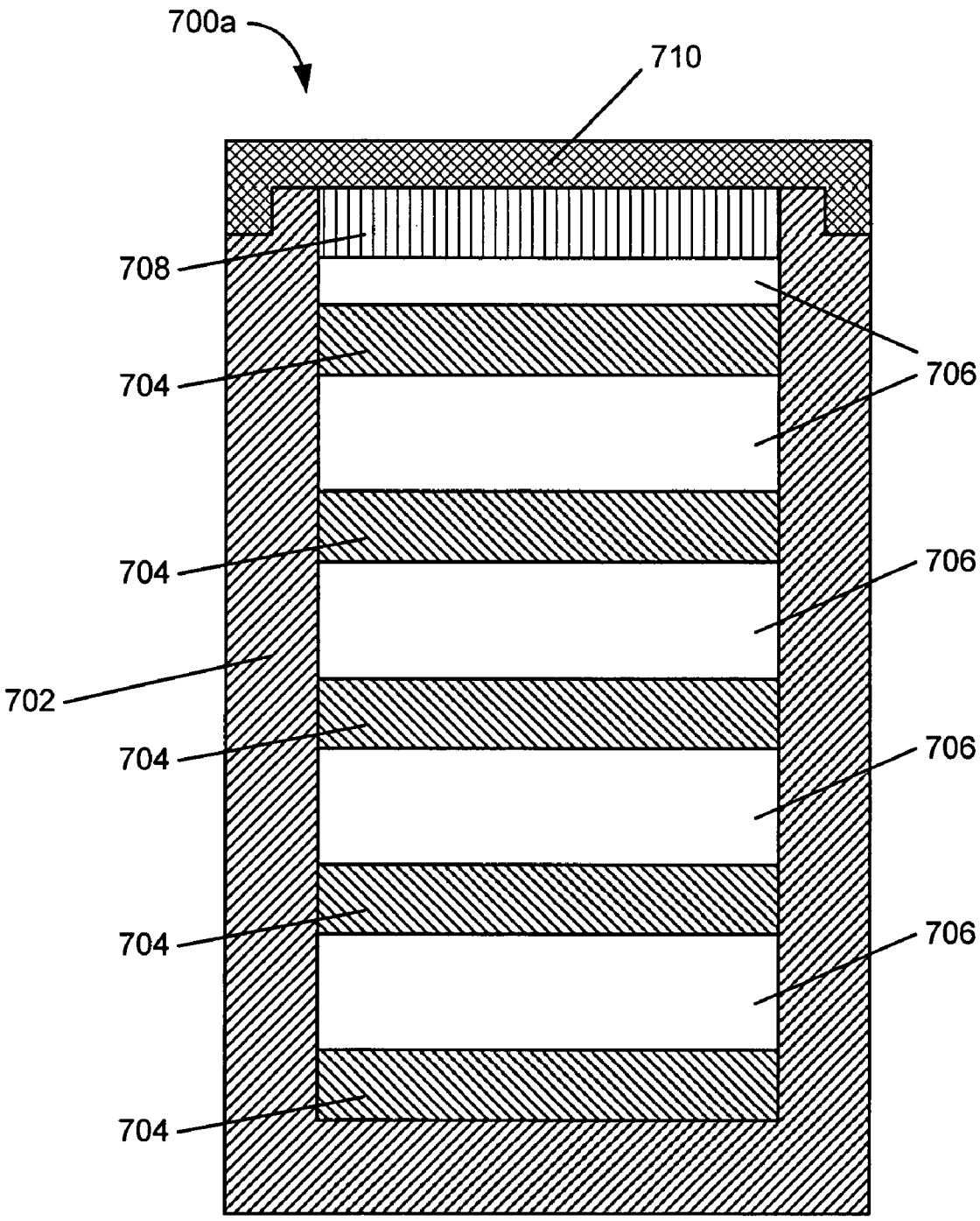
FIGS. 15A, 15B and 15C are cross-sectional views which illustrate three different embodiments of still another type of a volatile or vapor phase corrosion inhibitor system according to the present invention for use in combination with the synergistic systems of the present invention.

Referring to FIG. 15A, device 700*a* is shown. Device 700*a* includes a capsule 702 formed from any suitable non-degradable and/or corrosion resistant material. In one embodiment, capsule 702 is formed from any suitable metal (e.g., stainless steel, aluminum, etc.). In another embodiment, capsule 702 is formed from a suitable non-degradable polymer composition (e.g., a polyolefin polymer). Device 700*a* further includes alternating layers of degradable polymer 704 which contain at least one volatile or vapor phase corrosion inhibitor therein; layers of degradable polymer 706 which contains no volatile or vapor phase corrosion inhibitor therein, and a cover 710 which protects the layers of degradable polymer from degradation until device 700*a* is put into use.

The layers 704 and 706 can be any suitable thickness and can be arranged in any suitable manner. In one embodiment, the upper most layer is a degradable polymer layer 706 which contains no volatile or vapor phase corrosion inhibitor therein.

Device 700*a* can optionally include a porous or semi-permeable membrane 708 which permits at least the volatile or vapor phase corrosion inhibitor which is contained within the one or more degradable polymer layers 704 to escape from the interior of capsule 702.

Once the cover 710 is removed from device 700*a* and the device is placed inside of a desired tank, container, semi-closed system or closed system, a corrosive element or environment which exists in the tank, container, semi-closed system or closed system (or occurs over time) causes the degradation of the first layer of degradable polymer 706 which contain no volatile or vapor phase corrosion inhibitor. After the first layer 706 degrades to such a point, the first layer of degradable polymer 704 which contains at least one volatile or vapor phase corrosion inhibitor begins to degrade and release volatile or vapor phase corrosion inhibitor from device 700*a* into the surrounding environment.

Figure 15B:
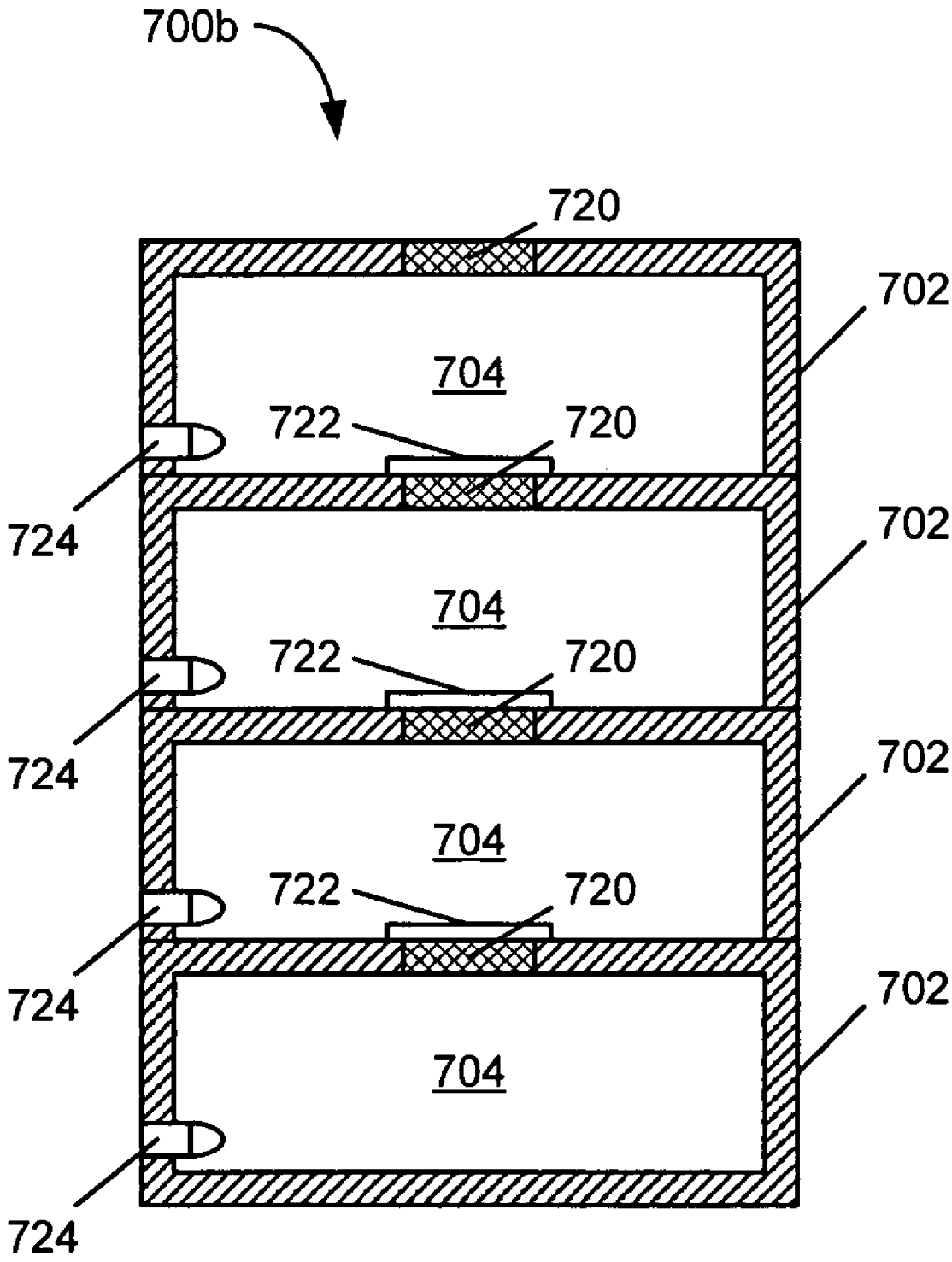

Referring to FIG. 15B, device 700*b* is shown. Device 700*b* includes two or more capsules 702 (four are shown) formed from any suitable non-degradable and/or corrosion resistant material. In one embodiment, capsules 702 are formed from any suitable metal (e.g., stainless steel, aluminum, etc.). In another embodiment, capsules 702 are formed from a suitable non-degradable polymer composition (e.g., a polyolefin polymer). In one embodiment, capsules 702 are connected together and share at least one common wall. Each of capsules 702 contain at least one volatile or vapor phase corrosion inhibitor 704 and at least one degradable plug or cap 720. The degradable plug or cap 720 may further have there over a degradable film 722 and may be formed from any suitable material (e.g., a degradable polymer).

In one embodiment, degradable plug or cap 720 degrades in the presence of a different compound than that of degradable film 722. For example, degradable plug or cap 720 can be designed to degrade in the presence of water or water vapor while degradable film 722 can be designed to degrade in oil or vice versa. Furthermore, device 700*b* may optionally include at least one valve 724 (e.g., a diaphragm or nipple valve) in one or more of the capsules 702. FIG. 15B includes therein an optional nipple valve 724 in each capsule 702.

Device 700*b* functions in a similar manner to that of device 700*a*, except for the fact that only degradable plugs or caps 720 and degradable films 722 degrade in the presence of one or more desired compounds. Additionally, valve 724 can be used either to release additional volatile or vapor phase corrosion inhibitor from capsules 702, refill the volatile or vapor phase corrosion inhibitor in the capsules 702, or both.

Figure 15C:
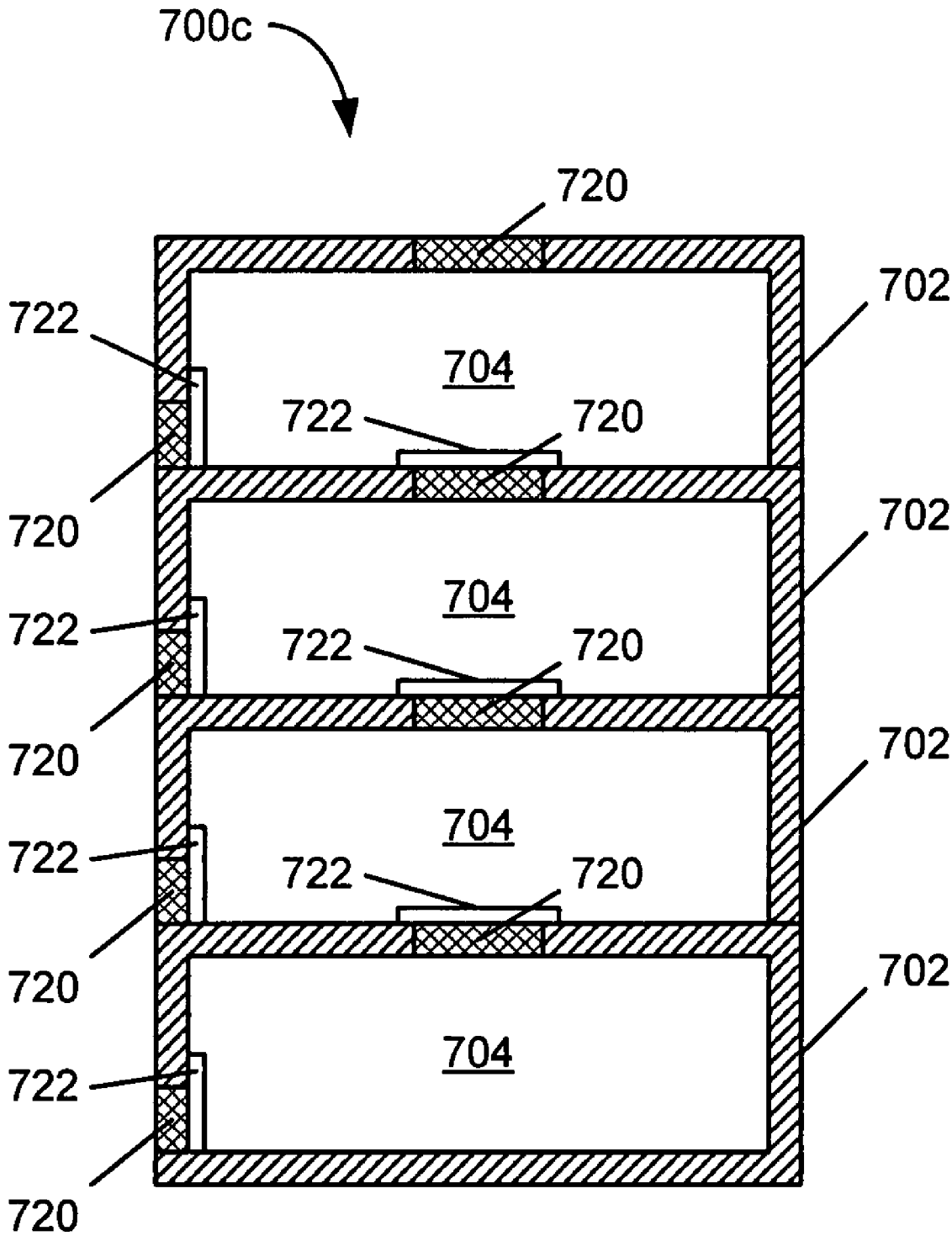

Turning to FIG. 15C, FIG. 15C depicts yet another variation of the devices of FIGS. 15A and 15B. Device 700*c* includes two or more capsules 702 (four are shown) formed from any suitable non-degradable and/or corrosion resistant material. In one embodiment, capsules 702 are formed from any suitable metal (e.g., stainless steel, aluminum, etc.). In another embodiment, capsules 702 are formed from a suitable non-degradable polymer composition (e.g., a polyolefin polymer). In one embodiment, capsules 702 are connected together and share at least one common wall. Each of capsules 702 contain at least one volatile or vapor phase corrosion inhibitor 704 and at least two degradable plugs or caps 720. At least one of the degradable plugs or caps 720 may further have there over a degradable film 722 and may be formed from any suitable material (e.g., a degradable polymer).

In one embodiment, each degradable plug or cap 720 degrades in the presence of a different compound than that of degradable film 722. For example, degradable plug or cap 720 can be designed to degrade in the presence of water or water vapor, while degradable film 722 can be designed to degrade in oil or vice versa. Furthermore, although not pictured, device 700*c* may optionally include at least one valve (e.g., a diaphragm or nipple valve) in one or more of the capsules 702 similar to that explained with regard to the embodiment of FIG. 15B.

Device 700*c* functions in a similar manner to that of device 700*b*, except for the fact that only degradable plugs or caps 720 and degradable films 722 degrade in the presence of one or more desired compounds. Additionally, if present, the one or more valves can be used either to release additional volatile or vapor phase corrosion inhibitor from capsules 702, refill the volatile or vapor phase corrosion inhibitor in the capsules 702, or both.

Figure 16A:
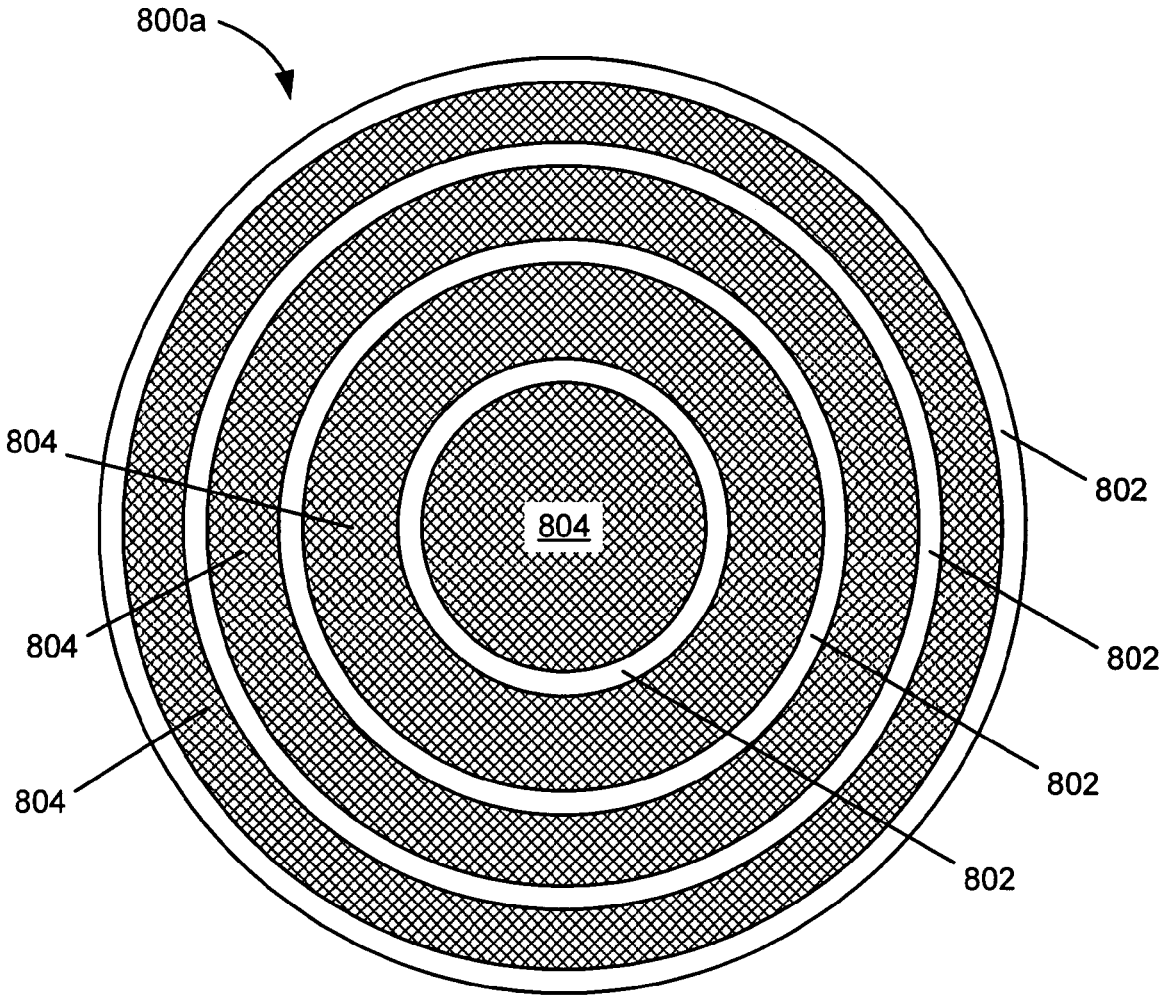
FIGS. 16A, 16B and 16C are cross-sectional views which illustrate three different embodiments of still another type of a volatile or vapor phase corrosion inhibitor system according to the present invention for use in combination with the synergistic systems of the present invention.
Figure 16B:
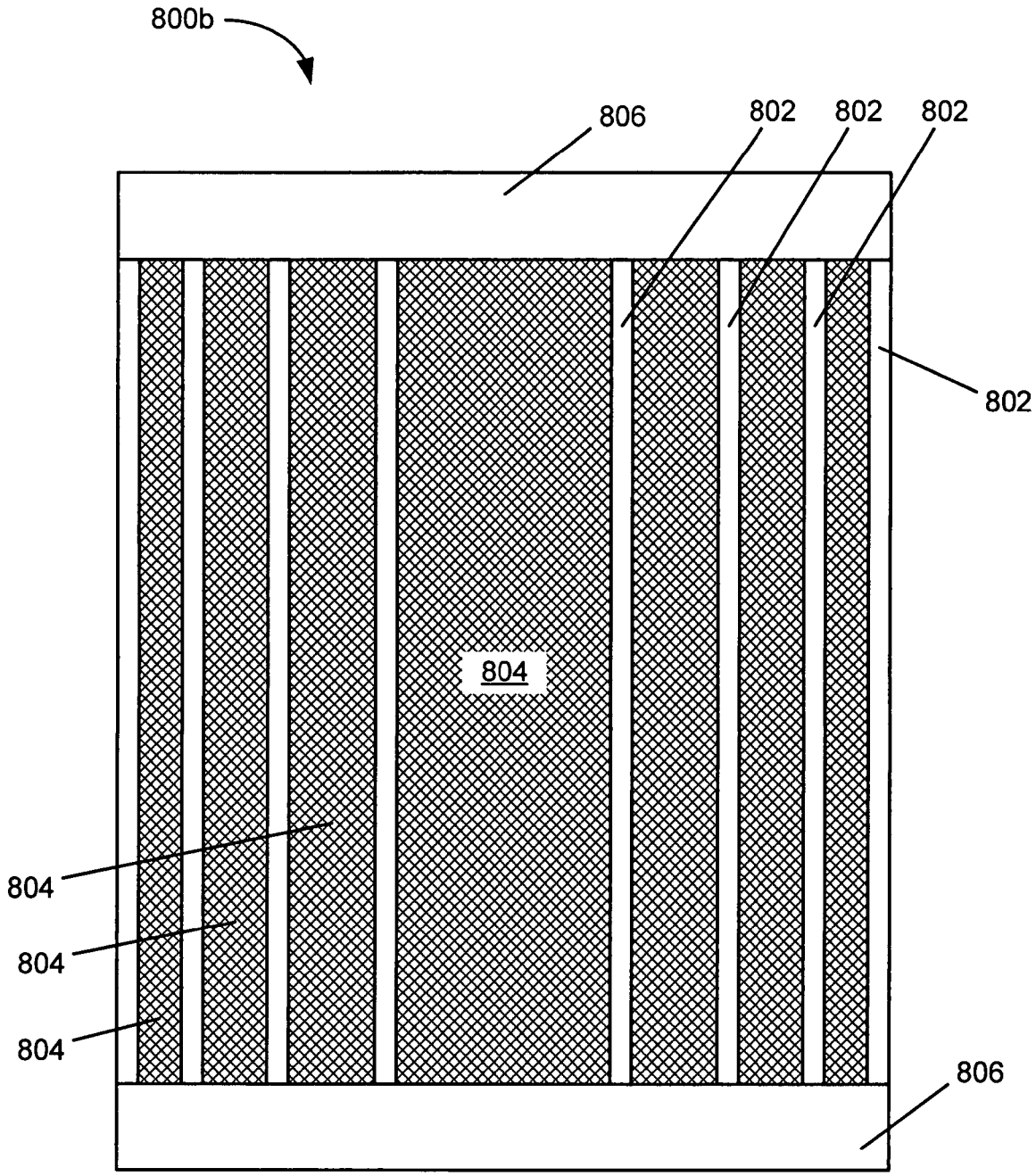
Figure 16C:
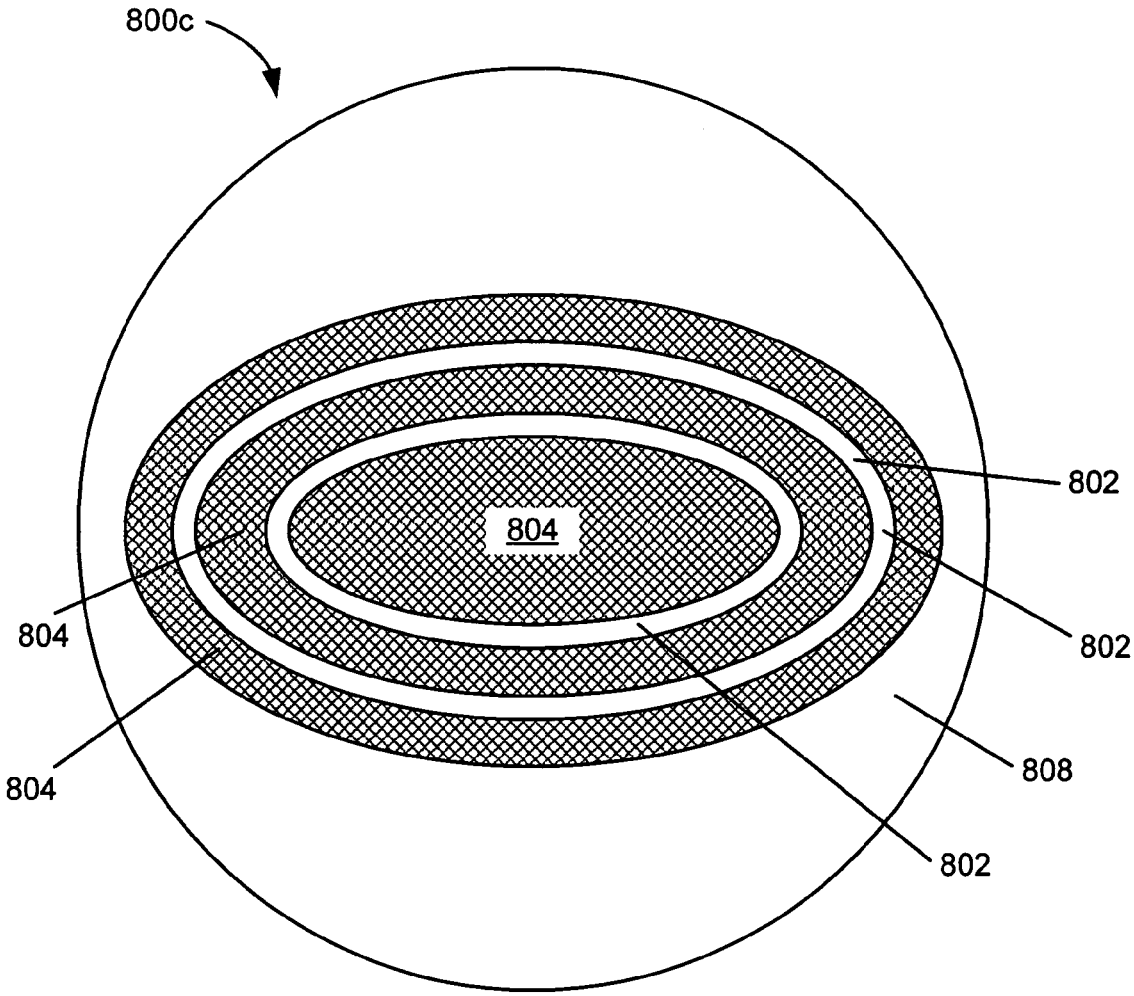

Referring to FIGS. 16A to 16C, devices 800*a*, 800*b* and 800*c* are shown. Devices 800*a*, 800*b* and 800*c* are similar in nature except for their shapes and/or sizes. All three of the devices, 800*a*, 800*b* and 800*c* include degradable polymer layers 802 which contain no volatile or vapor phase corrosion inhibitor and polymer layers 804 which contain at least one volatile or vapor phase corrosion inhibitor. Both polymer layers 802 and 804 can be formed from the same or different suitable degradable polymer materials. In one embodiment, the layers 802 and 804 are formed from a polymer material that degrades in the presence of one or more of water, oil, hydrogen chloride, hydrogen sulfide, sulfur dioxide, nitric oxide, $NO_x$, $SO_x$, chloride ions or oxygen.

As shown in FIGS. 16A to 16C, layers 802 and 804 are formed in an alternating manner. In one embodiment, a layer 802 is the outer layer. In another embodiment, a layer 804 is the outer layer. Furthermore, devices 800*b* and 800*c* include therein one or more caps 806 or outer layer 808 formed from a degradable polymer which contains no corrosion inhibitor. The thickness of such any caps 806 and/or outer layers 808 which may be present is not critical. These one or more caps 806 or outer layers 808 function t delay the degradation of layers 804 and can, in some circumstances, lead to an extended service life of devices 800*b* and 800*c*. Accordingly, in practice the thickness of any caps 806 and/or outer layers 808 which may be present is determined by the length of delay desired.

In one embodiment, each of the one or more layers 804 have equal volumes and therefore should take almost the same amount of time to degrade, thereby providing the same amount of service life per layer. In another embodiment, each of the one or more layers 804 have different volumes as desired for the application. In this case, each layer will, in most circumstances, have different degradation times and service lives. This discussion also applies to layers 802.

The devices of FIGS. 16A to 16C are utilized by placing one or more devices into the inside of a desired tank, container, semi-closed system or closed system, where a corrosive element or environment exists. Upon exposure to such an element or environment, the devices of FIGS. 16A to 16C begin to degrade.

Figure 17A:
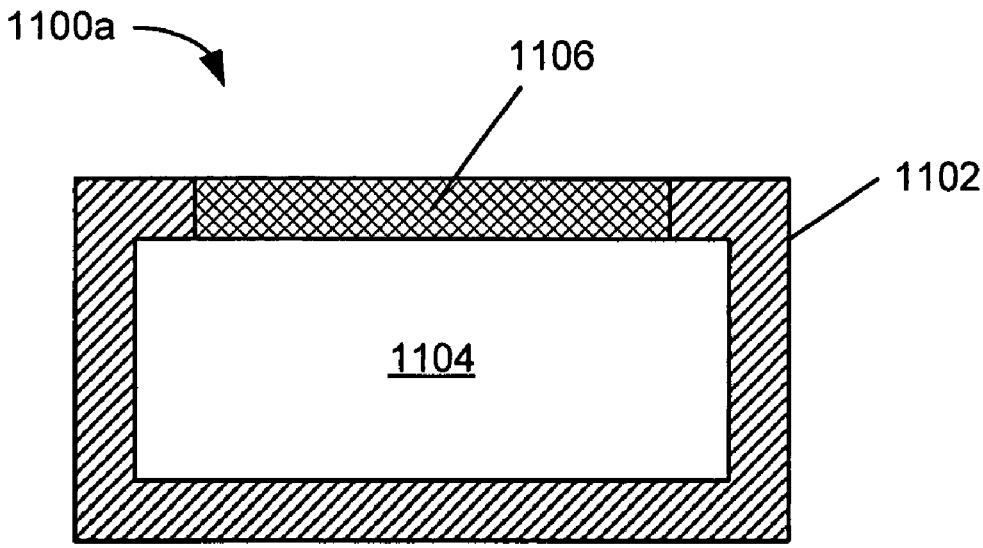
FIGS. 17A and 17B are cross-sectional views which illustrate two different embodiments of still another type of a volatile or vapor phase corrosion inhibitor system according to the present invention for use in combination with the synergistic systems of the present invention.
Figure 17B:
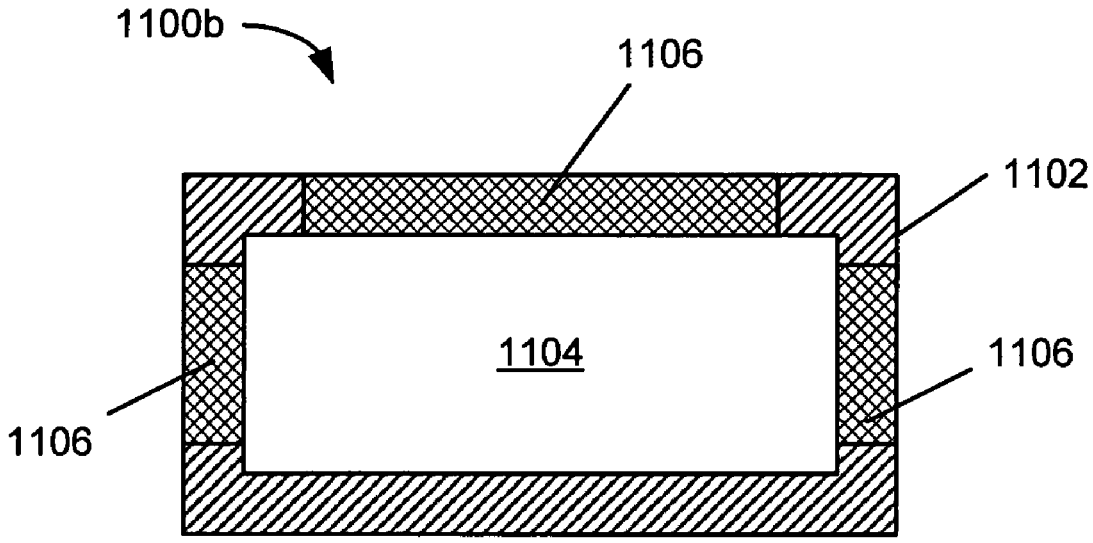

Referring to FIGS. 17A and 17B, FIGS. 17A and 17B depict yet another embodiment according to the present invention. The device 1100*a* of FIG. 17A includes a capsule 1102 formed of any suitable material. In one embodiment, capsule 1102 is formed from any suitable non-degradable or corrosion resistant metal (e.g., stainless steel, aluminum, etc.). In another embodiment, capsule 1102 is formed from a suitable non-degradable polymer composition (e.g., a polyolefin polymer). Although depicted as rectangular, capsule device 1100*a* can be made in any shape (e.g., spherical, square, pyramidal, etc.). The inside of capsule 1102 includes at least one suitable volatile or vapor phase corrosion inhibitor impregnated foam 1104 which contains one or more volatile or vapor phase corrosion inhibitors which are selected based upon the corrosive element or compound to be neutralized. The capsule 1102 also includes a venting portion 1106 which is permeable to the volatile or vapor phase corrosion inhibitor impregnated in foam 1104 and allows the one or more volatile or vapor phase corrosion inhibitors contained in foam 1104 to escape into the environment outside of capsule 1102.

This embodiment is not limited to the configuration depicted in FIG. 17A, rather any shape of volatile or vapor phase corrosion inhibitor impregnated with foam 1104 can be placed into the interior of capsule 1102. Additionally, device 1100*a* can further contain a cover which acts to seal venting portion 1106 and prevent escape of the volatile or vapor phase corrosion inhibitor contained in foam 1104 until desired. The cover can be made of any suitable material (e.g., a polymeric adhesive label, etc.).

In the embodiment of FIG. 17B, device 1100*b* is similar to device 1100*a* except for the addition of more than one venting portion 1106 (in this case three, although any number could be used). In this embodiment, one or all of the venting portions 1106 can be covered with a cover to prevent the early release of the volatile or vapor phase corrosion inhibitor contained in the foam 1104.

Furthermore, where applicable, a device according to this portion of the present invention which utilizes therein one or more degradable polymer compositions can be designed so as to yield controlled degradation based upon the environment into which the device of the present invention is to be placed. For example, a device according to the present invention could be designed so as to contain a polymer composition which has a limited solubility in a given environment. Such a design scenario would permit the present invention to yield devices which degrade very slowly in a given environment. Alternatively, select portions of a device according to the present invention may be designed so as to be degradable in a given environment.

With regard to the non-degradable polymer portions of any one of the devices according to this portion of the present invention, it should be noted that just because these portions are not designed to degrade in a given environment, it does not mean that such non-degradable polymer portions cannot be formed so as to be bio-degradable once the service life of the device has ended and the device has been committed to a suitable waste disposal site. Thus, the bio-degradation rate of the non-degradable portions of any one of the devices of the present invention can be selected so as not to adversely impact the service life of a device according to the present invention.

I. Volatilizable Compounds:

As is noted above, this portion of the present invention's synergistic corrosion management systems include therein at least one volatilizable inhibiting compound and/or formula. Any compound which is volatile can be used in the present invention, whether solid or liquid. In another embodiment, the one or more volatilizable compounds or formulas of the present invention can be contained in any suitable polymer or polymer film, foam, powder, tablet (e.g., the polymer can be a polyolefin or any suitable biodegradable polymer, such as a biodegradable polyester or copolyester polymer). Suitable types of volatilizable compounds and/or formulas include volatile corrosion inhibitors, volatile tarnish inhibitors, volatile anti-oxidant compounds, volatile anti-mildew compounds, volatile anti-bacterial compounds and/or volatile UV-protectants.

In one embodiment, any compound which is to be utilized in the present invention should generate a sufficient partial pressure at a temperature in the range of about 40° C. to about 90° C., or about 45° C. to about 85° C., or even from about 50° C. to about 80° C. In another embodiment, the partial pressure of the one or more volatilizable compounds should be at least about 3 to 100 times higher than the partial pressure of the one or more volatilizable compounds at 25° C.

In still another embodiment, the partial pressure of the one or more volatilizable compounds should be at least about 100 Pascals (Pa) instead of about 1 Pa, at least about 5 Pa instead of about 0.1 Pa, or even at least about $10^{-2}$ Pa instead of about $10^{-3}$ Pa, at any temperature within the above stated temperature ranges. A chart detailing vapor pressure for various inorganic and organic compounds and their partial pressures, or even greater than atmospheric pressures, at certain temperatures can be found in the *CRC Handbook of Chemistry and Physics,* 67th Edition, pages D-192 through D-212, which is hereby incorporated by reference for its disclosure relating to vapor pressure. Additional vapor pressure related material may also be found in the *CRC Handbook of Chemistry and Physics,* 77th Edition, pages 6-67 through 6-113, which is hereby incorporated by reference for its disclosure relating to vapor pressure.

In one embodiment, the present invention contains therein one or more volatilizable corrosion and/or tarnish inhibiting compounds or formulas.

A. Corrosion Inhibiting and Tarnish Inhibiting Compounds or Formulas:

The following formulas are exemplary corrosion inhibiting and/or tarnish inhibiting compounds or formulas and the present invention is not limited solely to the following compounds and/or formulas.

Any suitable corrosion inhibitor can be used in the present invention. As mentioned above, U.S. Pat. Nos. 4,290,912; 5,320,778; and 5,855,975 disclose vapor phase or volatile corrosion inhibitors and are incorporated herein by reference in their entirety for their teachings of such compounds. For example, useful vapor phase or volatile corrosion inhibitors include, but are not limited to, benzotriazole, and mixtures of benzoates of amine salts with benzotriazole, nitrates of amine salts and $C_{13}H_{26}O_2N$, certain amines and imines, imidazolines and/or imidazoles, triazoloes, pyridines, amides, phosphonates, and sulphonates and their derivatives. Other suitable corrosion inhibitors are described in *Corrosion Inhibitors: Principle and Applications*, V. S. Sastri, Wiley, New York, N.Y., 1998.

Alternatively, the present invention can utilize a biodegradable polymer-corrosion inhibitor combination as is disclosed in United States Published Patent Application No. 2004/0173779, which is incorporated herein in its entirety for its teaching of biodegradable polymer-corrosion inhibitor combinations. In still another embodiment, the present invention can utilize polymer miscible corrosion inhibiting compositions such as those disclosed in United States Published Patent Application No. 2004/0069972, which is incorporated herein in its entirety for its teaching of corrosion inhibiting compositions. In yet another embodiment, the present invention can utilize any of the corrosion inhibiting formulas and/or compounds disclosed in United States Published Patent Application No. 2003/0213936, which is incorporated herein in its entirety for its teaching of corrosion inhibiting compositions. In still yet another embodiment, the present invention can utilize a tarnish inhibiting compound or formula as disclosed in United States Published Patent Application Nos. 2004/00063837 and 2003/0207974, which are both incorporated in their entireties for their teachings of tarnish inhibiting compounds and/or formulas.

1. Exemplary Corrosion Inhibiting Formulas:

In one embodiment, a suitable corrosion inhibiting formula for inclusion into the present invention comprises a mixture of: (1a) at least one volatile corrosion inhibitor (VCI); (1b) at least one anti-oxidant; (1c) at least one alkali or alkaline-earth metal silicate or oxide; and (1d) fumed silica.

In another embodiment, the corrosion inhibiting formula comprises a mixture of: (2a) at least one volatile corrosion inhibitor (VCI); (2b) at least one anti-oxidant; (2c) at least one alkali or alkaline-earth metal silicate or oxide; (2d) fumed silica; and (2e) at least one chemically active compound.

In yet another embodiment, the corrosion inhibiting formula comprises a mixture of: (3a) an inorganic nitrite salt; (3b) a phenol represented by the formula:

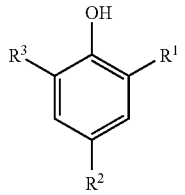

where $R^1$, $R^2$ and $R^3$ are selected from alkyl, aryl, alkenyl, hydroxyalkyl, hydroxyalkenyl and where the sum of carbon atoms in $R^1$, $R^2$ and $R^3$ is in the range of 3 to about 18; and (3c) fumed silica. All of the mixtures described above can further include additional additives.

a. Volatile Corrosion Inhibitors

Any suitable volatile corrosion inhibitor (or vapor phase corrosion inhibitor) can be utilized in the at least one corrosion inhibiting formula contained in the present invention. Again, some suitable volatile corrosion inhibitors are disclosed in U.S. Pat. Nos. 4,290,912; 5,320,778; and 5,855,975, which are all incorporated herein by reference in their entirety for their teachings of such inhibitors. For example, useful vapor phase or volatile corrosion inhibitors include, but are not limited to, triazoles and/or inorganic nitrites (e.g., nitrite salts).

In one embodiment, exemplary inorganic nitrite salts include, but are not limited to, metal nitrites, such as sodium nitrite, potassium nitrite and barium nitrite. In another embodiment, any suitable Group 1 or Group 2 nitrite (New Notation System) can be used in the at least one corrosion inhibiting formula contained in the present invention.

In another embodiment, the one or more vapor phases or volatile corrosion inhibitors utilized in the present invention can be a triazole. Exemplary triazoles include, but are not limited to, benzotriazole, tolytriazole and/or sodium tolytriazole.

In yet another embodiment, the vapor phase or volatile corrosion inhibitor utilized in the present invention can be any suitable mixture of two or more of the above-mentioned inhibitors.

b. Anti-Oxidants

Any suitable anti-oxidant can be utilized in the at least one corrosion inhibiting formula contained in the present invention. Exemplary anti-oxidants include, but are not limited to, tri-substituted phenols independently substituted in the 2, 4 and 6 positions with one or more alkyl, hydroxyalkyl, aryl, alkenyl or hydroxyalkenyl groups of the general formula shown below:

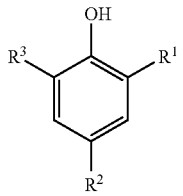

In one embodiment, the sum of the carbon atoms present in the substituent groups $R^1$, $R^2$ and $R^3$ is in the range of 3 to about 36, or even in the range of 3 to about 18.

In another embodiment, a mixture of two or more of the above-mentioned anti-oxidants can be utilized in the at least one corrosion inhibiting formula contained in the present invention.

c. Alkali/Alkaline-Earth Metal Silicates/Oxides

Any suitable Group 1 or 2 silicate or oxide can be utilized in the at least one corrosion inhibiting formula contained in the present invention. Exemplary silicates include lithium silicate, sodium silicate, potassium silicate and barium silicate. With regard to the silicates utilized in the at least one corrosion inhibiting formula contained in the present invention, the weight ratio of alkali or alkaline-earth metal oxide to silicate can vary. In one embodiment, this ratio of metal oxide to silicate is from about 5:1 to about 1:5. In another embodiment, the ratio of metal oxide to silicate is from about 3:1 to about 1:3.

In another embodiment, a mixture of one or more silicates can be utilized in the at least one corrosion inhibiting formula contained in the present invention. In yet another embodiment, the one or more silicates can be in a glassy or crystalline state.

In yet another embodiment, at least one alkali or alkaline-earth metal oxide is utilized in the at least one corrosion inhibiting formula contained in the present invention rather than, or in addition to, the one or more silicates discussed above. Exemplary alkali and alkaline-earth metal oxides include, but are not limited to, magnesium oxide, calcium oxide, strontium oxide and barium oxide. In another embodiment, a mixture of two or more alkali or alkaline-earth metal oxides can be utilized in the at least one corrosion inhibiting formula of the present invention.

d. Fumed Silica

Any suitable fumed silica can be utilized in the at least one corrosion inhibiting formula contained in the present invention. Suitable fumed silicas are available under the tradenames Cab-O-Sil from Cabot Corporation and Aerosil from American Cyanamid.

e. Chemically Active Compound

If present, the at least one chemically active compound utilized in the at least one corrosion inhibiting formula contained in the present invention can be an oxide compound, or combination thereof, which can react with one or more compounds to form compounds which are insoluble in aqueous environments. Exemplary chemically active compounds include, but are not limited to, iron oxides (both ferrous oxide and ferric oxide), cobalt oxide, nickel oxide, copper oxides (both cuprous oxide and cupric oxide) and zinc oxide.

In another embodiment, mixtures of two or more of the above-mentioned oxides can be utilized.

f. Additional Additives

In addition to components (1a) to (1d) (or (2a) to (2e)), the at least one corrosion inhibiting formula contained in the present invention may also contain other additives, such as UV-protectants, anti-bacterials, anti-mildews, etc.

In one embodiment, the one or more corrosion inhibiting formulas contained in the present invention are acid-free (i.e., the mixtures contain an amount, if any, of acidic compounds which does not adversely affect the final pH of the corrosion inhibiting formulas of the present invention). For example, in one embodiment, acid free can mean having a pH of more than about 5, or more than about 6, or even more than about 7.

In another embodiment, the one or more corrosion inhibiting formulas contained in the present invention optionally contain at least one odor-suppressing compound. Such compounds include, but are not limited to, iron oxides (both ferrous oxide and ferric oxide), cobalt oxide, nickel oxide, copper oxides (both cuprous oxide and cupric oxide), zinc oxide, magnesium oxide and calcium oxide.

g. Examples

The above corrosion inhibiting formulas are further illustrated by the following examples wherein the term "parts" refers to parts by weight unless otherwise indicated. The following examples are not meant to be limiting, rather they are illustrative of only a few embodiments within the scope of the present invention.

Examples A-1 to A-3 describe the preparation of corrosion inhibiting formulas.

Example A-1

| | |
|---|---|
| Sodium Nitrate | 2.5 Parts |
| Sodium Silicate[1] | 0.2 parts |
| "Ionol"[2] | 0.5 parts |
| "Cab-O-Sil"[3] | 0.1 parts |

[1]Sodium Silicate is a glassy product with a weight ratio of silica to sodium oxide of 2 (commercially available from the PQ Corporation).
[2]"Ionol" is 2,6-di-tert-butyl-4-methyl phenol (commercially available from the Uniroyal Chemical Company).
[3]"Cab-O-Sil" is fumed silica (commercially available from the Cabot Corporation).

Example A-2

| | |
|---|---|
| Sodium Nitrite | 2.5 parts |
| Sodium Silicate | 0.2 parts |
| "Cobratec TT-85"[4] | 0.5 parts |
| "Ionol" | 0.5 parts |
| "Cab-O-Sil" | 0.1 parts |

[4]"Cobratec TT-85" is sodium tolyltriazole, a corrosion inhibitor commercially available from the Sherwin-Williams Company.

Example A-3

| | |
|---|---|
| Sodium Nitrite | 2.5 parts |
| Sodium Silicate | 0.2 parts |
| "Ionol" | 0.5 parts |
| "Cobratec TT-85" | 0.5 parts |
| Zinc Oxide | 1.0 parts |
| "Cab-O-Sil" | 0.1 parts |

2. Exemplary Tarnish Inhibiting Formulas:

As noted above, in one embodiment, the present invention relates to systems which can contain therein at least one tarnish inhibiting formula which comprises a mixture of: (4a) at least one strong alkali compound; and (4b) at least one compound which yields an insoluble sulfide. This mixture can further include one or more additional additives, such as anti-oxidants, corrosion inhibitors, etc.

a. Strong Alkali Compound

Any suitable Group 1 or 2 silicate or oxide can be utilized in the at least one tarnish inhibiting formula contained in the present invention as component (4a), the at least one strong alkali compound. Exemplary silicates include, but are not limited to, lithium silicate, sodium silicate, potassium silicate and barium silicate. With regard to the silicates utilized in the present invention, the weight ratio of alkali or alkaline-earth metal oxide to silicate can vary. In one embodiment, this ratio of metal oxide to silicate is from about 5:1 to about 1:5. In another embodiment, the ratio of metal oxide to silicate is from about 2.5:1 to about 1:2.5.

In another embodiment, a mixture of one or more silicates can be used in the at least one tarnish inhibiting formula contained in the present invention. In yet another embodiment, the one or more silicates can be in a glassy or crystalline state.

In yet another embodiment, the at least one alkali or alkaline-earth metal oxide is utilized in the at least one tarnish inhibiting formula contained in the present invention rather than the one or more silicates. Exemplary alkaline-earth metal oxides include, but are not limited to, magnesium oxide, calcium oxide, strontium oxide and barium oxide. In another embodiment, a mixture of two or more alkali or alkaline-earth metal oxides can be utilized in the at least one tarnish inhibiting formula contained in the present invention.

While not wishing to be bound to any one theory, it is believed that the one or more strong alkali compounds react with any hydrogen sulfide ($H_2S$) and/or any acid compounds present in the environment. This prevents such compounds and/or acids from passing through the polymer matrix of a polymer article which optionally contains therein a tarnish inhibiting formula, according to the present invention.

b. Compounds which Yield Insoluble Compounds

Any suitable compound which forms an insoluble compound, such as a sulfide (solubility of less than about 0.1 grams/liter of water) when $H_2S$ is present, can be utilized in the at least one tarnish inhibiting formula contained in the present invention as component (4b), the compound which yields an insoluble sulfide. Exemplary compounds include, but are not limited to, compounds containing iron, cobalt, nickel, copper and zinc. Mixtures of two or more such compounds can also be utilized in the at least one tarnish inhibiting formula contained in the present invention. Suitable anions for the compound according to component (4b) include oxides and hydroxides.

Exemplary compounds include, but are not limited to, zinc oxide, zinc hydroxide, iron oxides (both ferrous oxide and ferric oxide), iron hydroxide ($Fe(OH)_2$), cobalt oxide, cobalt hydroxides (both $Co(OH)_2$ and $CO_2O_3.3H_2O$), nickel oxide, nickel (II) hydroxide, copper oxides (both cuprous oxide and cupric oxide) and copper hydroxide. Mixtures of two or more of the above compounds can also be utilized as component (4b).

c. Volatile Corrosion Inhibitors

In one embodiment, the tarnish inhibiting formula contained in the present invention further includes any suitable volatile corrosion inhibitor (or vapor phase corrosion inhibitor). Some suitable volatile corrosion inhibitors are disclosed in U.S. Pat. Nos. 4,290,912; 5,320,778; and 5,855,975, which are all incorporated herein by reference in their entirety for their teachings of such inhibitors. For example, useful vapor phase or volatile corrosion inhibitors include, but are not limited to, triazoles and/or inorganic nitrites (e.g., nitrite salts).

Exemplary inorganic nitrite salts include, but are not limited to, metal nitrites, such as sodium nitrite, potassium nitrite and barium nitrite. In another embodiment, any suitable Group 1 or Group 2 nitrite (New Notation System) can be used in the one or more tarnish inhibiting formulas contained in the present invention.

In another embodiment, if present, the one or more tarnish inhibiting formulas contained in the present invention can optionally include one or more vapor phase or volatile corrosion inhibitors selected from triazoles. Exemplary triazoles include, but are not limited to, benzotriazole, tolyltriazole and/or sodium tolyltriazole.

In yet another embodiment, the optional vapor phase or volatile corrosion inhibitor utilized in the present invention can be any suitable mixture of two or more of the above-mentioned volatile corrosion inhibitors.

d. Anti-Oxidants

If desired, any suitable anti-oxidant can be utilized in the tarnish inhibiting portion of the present invention. Exemplary anti-oxidants include, but are not limited to, tri-substituted phenols substituted in the 2, 4 and 6 positions with one or more alkyl, hydroxyalkyl, aryl, alkenyl or hydroxyalkenyl groups of the general formula shown below.

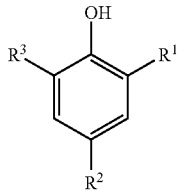

In one embodiment, the sum of the carbon atoms present in the substituent groups $R^1$, $R^2$ and $R^3$ is in the range of 3 to about 36, or even in the range of 3 to about 18.

In another embodiment, a mixture of two or more of the above-mentioned anti-oxidants can be utilized in the tarnish inhibiting portion of the present invention.

e. Additional Additives

In addition to components (4a) and (4b), the tarnish inhibiting formulas optionally contained in the present invention may also contain other additives such as, UV-protectants, anti-bacterials, anti-mildews, etc.

In one embodiment, the one or more corrosion inhibiting formulas contained in the present invention are acid-free (i.e., the mixtures contain an amount, if any, of acidic compounds which do not adversely affect the final pH of the corrosion inhibiting formulas of the present invention). For example, in one embodiment, acid free can mean having a pH of more than about 5, or more than about 6, or even more than about 7.

In another embodiment, a tarnish inhibiting formula, according to the present invention, optionally contains an odor-suppressing compound. Such compounds include, but are not limited to, iron oxides (both ferrous oxide and ferric oxide), cobalt oxide, nickel oxide, copper oxides (both cuprous oxide and cupric oxide), zinc oxide, magnesium oxide and calcium oxide.

f. Examples

The above tarnish inhibiting formulas are further illustrated by the following example wherein the term "parts" refers to parts by weight unless otherwise indicated. The following example is not meant to be limiting, rather it is illustrative of only one embodiment within the scope of the present invention.

Example B-1

(a) The following compounds are mixed to form a tarnish inhibiting formula. This tarnish inhibiting formula is illustrated by the following example wherein the term "parts" refers to parts by weight unless otherwise indicated.

| | |
|---|---|
| Sodium Silicate | 25 parts |
| Zinc Oxide | 25 parts |

3. Other Corrosion Inhibiting Formulas and Compounds:

In yet another embodiment, the present invention relates to systems which contain therein at least one corrosion inhibiting formula which comprises a mixture of: (3a) an inorganic nitrite salt, (3b) a trisubstituted phenol and (3c) fumed silica.

The useful inorganic nitrite salts include metal nitrites (such as Group I and II metal nitrites), including potassium nitrite, sodium nitrite and calcium nitrite. In one embodiment, the nitrite salt is sodium nitrite.

The trisubstituted phenols which are useful are substituted in the 2, 4 and 6 positions with alkyl, hydroxyalkyl, aryl, alkenyl or hydroxyalkenyl. In one embodiment, the phenol is 2,6 di-t-butyl-4-methyl phenol.

Any suitable fumed silica can be utilized. An exemplary fumed silica is available commercially under the tradename "Cab-O-Sil" from the Cabot Corporation.

This corrosion inhibiting formula is further illustrated by means of the following example wherein the term "parts" refers to parts by weight unless otherwise indicated. The following example is not meant to be limiting, rather it is illustrative of only one embodiment within the scope of the present invention.

Example C-1

| | |
|---|---|
| Sodium Nitrite | 3 parts |
| "Ionol" | 2 parts |
| "Cab-O-Sil" | 0.1 parts |
| Oleyl Alcohol | 3 parts |

As is noted above, in the present invention utilizes a three-part system to provide corrosion protection to the bottoms, or double bottoms, of tanks, containers, enclosures, or semi-closed or closed systems. In one instance, the present invention relates to above ground storage tanks, and in particular to above ground storage tanks with double bottoms.

Some factors facing such tanks, containers, enclosures, or semi-closed or closed systems include, but are not limited to, atmosphere issues (atmospheric composition, humidity, temperature, etc.); the level and frequency of changes in the level of contents stored in such tanks, containers, enclosures, or semi-closed or closed systems (i.e., frequency of filling and emptying); the nature of the aqueous-based solutions (e.g., water) that come into contact with one or more corrodible surfaces of such tanks, containers, enclosures, or semi-closed or closed systems (these can include, but are not limited to, corrosive element concentration therein, pH, temperature, etc.); the amount and duration of any vapor spaces in any portion of such tanks, containers, enclosures, or semi-closed or closed systems.

Although the invention has been shown and described with respect to certain embodiments, it is obvious that equivalent alterations and modifications will occur to others skilled in the art upon the reading and understanding of this specification. In particular with regard to the various functions performed by the above described components, the terms (including any reference to a "means") used to describe such components are intended to correspond, unless otherwise indicated, to any component which performs the specified function of the described component (e.g., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more other features of the other embodiments as may be desired and advantageous for any given or particular application.

What is claimed is:

1. A synergistic system for protecting a portion of a pre-existing tank, enclosure, or container, the system comprising:

(i) a pre-existing tank, enclosure, or container having a bottom or double bottom, wherein a pre-existing tank, enclosure, or container has an area located below the bottom, or double bottom, thereof;

(ii) at least one volatile or vapor phase corrosion inhibitor, wherein at least a portion of the at least one volatile or vapor phase corrosion inhibitor is located in at least one vapor space that exists in the area located below the bottom, or double bottom, of a pre-existing tank, enclosure, or container, and wherein the at least one volatile or vapor phase corrosion inhibitor is selected so as to prevent or reduce the amount of one or more corrosive compounds in the at least one vapor space that exists in the area located below a bottom, or double bottom, of a pre-existing tank, enclosure, or container;

(iii) at least one soluble corrosion inhibitor, wherein the at least one soluble corrosion inhibitor is contained within a suitable solvent, wherein the at least one soluble corrosion inhibitor-solvent combination is located in a portion of the area located below the bottom, or double bottom, of a pre-existing tank, enclosure, or container, and wherein the at least one soluble corrosion inhibitor is selected so as to prevent or reduce the amount of one or more corrosive compounds in at least one liquid that is contained, or located, within the area located below a bottom, or double bottom, of a pre-existing tank, enclosure, or container; and (iv) at least one cathodic-based corrosion prevention or mitigation system, wherein the at least one cathodic-based corrosion prevention or mitigation system is located in the area located below the bottom, or double bottom, of a pre-existing tank, enclosure, or container, and wherein the at least one cathodic-based corrosion prevention or mitigation system is designed to prevent or reduce the amount of corrosion that occurs in at least one metal bottom, or double bottom, portion of a pre-existing tank, enclosure, or container, wherein the at least one volatile or vapor phase corrosion inhibitor and the at least one soluble corrosion inhibitor are different chemical compounds.

2. The synergistic system of claim 1, wherein the at least one volatile or vapor phase corrosion inhibitor is selected from mixtures of benzoates of amine salts with benzotriazole, nitrates of amine salts, $C_{13}H_{26}O_2N$, pyridine, imidazolines, imidazoles, amines, phosphonates, nitrites, or suitable mixtures of two or more thereof.

3. The synergistic system of claim 1, wherein the at least one soluble corrosion inhibitor is selected from mixtures of $ZnSO_4$ and $NaH_2PO_4$, organic nitrites, and organic amino-phosphites.

4. The synergistic system of claim 3, wherein the at least one soluble corrosion inhibitor is in the form of a powder prior to combination with a suitable solvent.

5. The synergistic system of claim 3, wherein the at least one soluble corrosion inhibitor is in the form of a nano-sized powder prior to combination with a suitable solvent.

6. The synergistic system of claim 5, wherein the nano-sized particles are substantially spherical in shape and have an average diameter of less than about 2500 nanometers.

7. The synergistic system of claim 5, wherein the nano-sized particles are substantially spherical in shape and have an average diameter of less than about 1000 nanometers.

8. The synergistic system of claim 5, wherein the nano-sized particles are substantially spherical in shape and have an average diameter of less than about 500 nanometers.

9. The synergistic system of claim 5, wherein the nano-sized particles are substantially spherical in shape and have an average diameter of less than about 250 nanometers.

10. The synergistic system of claim 1, wherein the solvent is selected from aqueous solutions of $Na_2MoO_4$, $ZnSO_4$, $Na_3PO_4$, $NaH_2PO_4$, $NaNO_2$, $Na_2SiO_3$, calcium phosphonate, imidazole, or suitable mixtures of two or more thereof.

11. The synergistic system of claim 1, wherein the at least one cathodic-based corrosion prevention or mitigation system is selected from one or more galvanic or impressed current systems, or a combination thereof.

12. The synergistic system of claim 11, wherein the at least one cathodic-based corrosion prevention or mitigation system is selected from one or more galvanic systems that utilize sacrificial anodes, one or more impressed current systems that utilize anodes, one or more cathodic systems that utilize impressed current, one or more cathodic systems that utilize reference electrodes, or a combination of two or more thereof.

13. The synergistic system of claim 1, wherein the system further comprises at least one insulating liner positioned in an area below the bottom, or double bottom, of a tank, enclosure, or container.

14. The synergistic system of claim 1, wherein the at least one volatile corrosion inhibitor is contained within one or more trays, wherein the one or more trays are located in an area below the bottom, or double bottom, of a tank, enclosure, or container.

15. The synergistic system of claim 1, further comprising at least one additional device designed to provide corrosion protection and/or mitigation to a non-bottom, or non-double bottom, portion of the tank, enclosure, or container.

16. The synergistic system of claim 15, wherein the at least one additional device is located on the internal floating top portion of the tank, enclosure, or container.

17. The synergistic system of claim 15, wherein the at least one additional device is located on the external top portion of the tank, enclosure, or container.

18. The synergistic system of claim 15, wherein the at least one additional device is located with a liquid storage area of the tank, enclosure, or container.

19. A synergistic system for protecting a portion of a pre-existing tank, enclosure, or container, the system comprising:

(a) a pre-existing tank, enclosure, or container having a bottom or double bottom, wherein a pre-existing tank, enclosure, or container has an area located below the bottom, or double bottom, thereof;

(b) at least one volatile or vapor phase corrosion inhibitor, wherein at least a portion of the at least one volatile or vapor phase corrosion inhibitor is located in at least one vapor space that exists in the area located below the bottom, or double bottom, of a pre-existing tank, enclosure, or container, and wherein the at least one volatile or vapor phase corrosion inhibitor is designed to prevent or reduce the amount of one or more corrosive compounds in the at least one vapor space that exists in the area located below a bottom, or double bottom, of a pre-existing tank, enclosure, or container;

(c) at least one soluble corrosion inhibitor, wherein the at least one soluble corrosion inhibitor is contained within a suitable solvent, wherein the at least one soluble corrosion inhibitor-solvent combination is located in a portion of the area located below the bottom, or double bottom, of a pre-existing tank, enclosure, or container, and wherein the at least one soluble corrosion inhibitor is designed to prevent or reduce the amount of one or more corrosive compounds in at least one liquid that is contained, or located, within the area located below a bottom, or double bottom, of a pre-existing tank, enclosure, or container; and (d) at least one electrolyte-based cathodic corrosion prevention or mitigation system, wherein the electrolyte of the at least one electrolyte-based cathodic corrosion prevention or mitigation system also serves as the solvent for the at least one soluble corrosion inhibitor, and wherein the at least one electrolyte-based cathodic corrosion prevention or mitigation system is located in the area located below the bottom, or double bottom, of a pre-existing tank, enclosure, or container, and wherein the at least one cathodic-based corrosion prevention or mitigation system is designed to prevent or reduce the amount of corrosion that occurs in at least one metal bottom, or double bottom, portion of a pre-existing tank, enclosure, or container, wherein the at least one volatile or vapor phase corrosion inhibitor and the at least one soluble corrosion inhibitor are different chemical compounds.

20. The synergistic system of claim 19, wherein the at least one volatile or vapor phase corrosion inhibitor is selected from mixtures of benzoates of amine salts with benzotriazole, nitrates of amine salts, $C_{13}H_{26}O_2N$, pyridine, imidazolines, imidazoles, amines, phosphonates, nitrites, or suitable mixtures of two or more thereof.

21. The synergistic system of claim 19, wherein the at least one soluble corrosion inhibitor is selected from mixtures of $ZnSO_4$ and $NaH_2PO_4$, organic nitrites, and organic amino-phosphites.

22. The synergistic system of claim 21, wherein the at least one soluble corrosion inhibitor is in the form of a powder prior to combination with a suitable solvent.

23. The synergistic system of claim 21, wherein the at least one soluble corrosion inhibitor is in the form of a nano-sized powder prior to combination with a suitable solvent.

24. The synergistic system of claim 23, wherein the nano-sized particles are substantially spherical in shape and have an average diameter of less than about 2500 nanometers.

25. The synergistic system of claim 23, wherein the nano-sized particles are substantially spherical in shape and have an average diameter of less than about 1000 nanometers.

26. The synergistic system of claim 23, wherein the nano-sized particles are substantially spherical in shape and have an average diameter of less than about 500 nanometers.

27. The synergistic system of claim 23, wherein the nano-sized particles are substantially spherical in shape and have an average diameter of less than about 250 nanometers.

28. The synergistic system of claim 19, wherein the at least one electrolyte-based cathodic-based corrosion prevention or mitigation system is selected from one or more galvanic or impressed current systems, or a combination thereof.

29. The synergistic system of claim 28, wherein the at least one electrolyte-based cathodic-based corrosion prevention or mitigation system is selected from one or more galvanic systems that utilize sacrificial anodes, one or more impressed current systems that utilize anodes, one or more cathodic systems that utilize impressed current, one or more cathodic systems that utilize reference electrodes, or a combination of two or more thereof.

30. The synergistic system of claim 19, wherein the system further comprises at least one insulating liner positioned in an area below the bottom, or double bottom, of a tank, enclosure, or container.

31. The synergistic system of claim 19, wherein the at least one volatile corrosion inhibitor is contained within one or more trays, wherein the one or more trays are located in an area below the bottom, or double bottom, of a tank, enclosure, or container.

32. The synergistic system of claim 19, further comprising at least one additional device designed to provide corrosion protection and/or mitigation to a non-bottom, or non-double bottom, portion of the tank, enclosure, or container.

33. The synergistic system of claim 32, wherein the at least one additional device is located on the internal floating top portion of the tank, enclosure, or container.

34. The synergistic system of claim 32, wherein the at least one additional device is located on the external top portion of the tank, enclosure, or container.

35. The synergistic system of claim 32, wherein the at least one additional device is located with a liquid storage area of the tank, enclosure, or container.

* * * * *